US007748997B2

(12) United States Patent
Hamner et al.

(10) Patent No.: US 7,748,997 B2
(45) Date of Patent: Jul. 6, 2010

(54) RECEPTACLE FOR ELECTRICAL CONNECTORS

(75) Inventors: Richard Elof Hamner, Hummelstown, PA (US); Scott Stephen Duesterhoeft, Etters, PA (US); Eric Leonard Himelright, Harrisburg, PA (US); Jason M'Cheyne Reisinger, Carlisle, PA (US); Jeffrey A. Schleig, York Haven, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/177,320

(22) Filed: Jul. 22, 2008

(65) Prior Publication Data

US 2010/0022135 A1 Jan. 28, 2010

(51) Int. Cl.
*H01R 12/00* (2006.01)

(52) U.S. Cl. ..... 439/79; 439/607.01

(58) Field of Classification Search ..... 439/79, 439/80, 607.01, 607.05, 607.07, 607.09
See application file for complete search history.

(56) References Cited

U.S. PATENT DOCUMENTS 5,266,038 A * 11/1993 Nakamura ..... 439/79
5,863,222 A * 1/1999 Kinsey et al. ..... 439/607.53
5,975,954 A 11/1999 Wu et al.
6,059,581 A * 5/2000 Wu ..... 439/79
6,186,830 B1 * 2/2001 Lin et al. ..... 439/607.4
6,416,359 B1 * 7/2002 Zhang et al. ..... 439/607.37
6,592,381 B2 * 7/2003 Cohen et al. ..... 439/80
D480,685 S 10/2003 Hagiwara
6,935,870 B2 8/2005 Kato et al.
7,077,668 B2 7/2006 Lapidot et al.
7,267,515 B2 * 9/2007 Lappohn ..... 439/607.07
7,503,804 B2 * 3/2009 Minich ..... 439/607.05

* cited by examiner

*Primary Examiner*—Thanh-Tam T Le

(57) ABSTRACT

A receptacle assembly for an electrical connector is provided. The assembly includes a housing, a plurality of electrical contacts and a shield. The housing includes a mating end and a mounting end that are orthogonal to each other. The mating end of the housing is elongated along a longitudinal axis of the housing. The electrical contacts are held by the housing and extend between a mating end presented at the mating end of the housing and a mounting end configured to be mounted to a circuit board. The shield has a mating interface elongated along a longitudinal axis. The shield is configured to receive the electrical connector. The housing and the contacts are located within the shield. The longitudinal axes of the housing and the mating interface are orthogonal to the circuit board.

17 Claims, 21 Drawing Sheets

RECEPTACLE FOR ELECTRICAL CONNECTORS

BACKGROUND OF THE INVENTION

The subject matter herein generally relates to receptacles for electrical connectors and, more particularly, to receptacles for connectors capable of communicating multimedia signals.

Electrical connectors that communicate multimedia signals can include connectors such as High-Definition Multimedia Interface ("HDMI") connectors. HDMI connectors are inserted into HDMI receptacles to communicate data and especially multimedia data. The multimedia data includes audiovisual signals, for example. The receptacles can be included in a variety of devices such as computers, digital video recorders, set top boxes and televisions, for example.

Existing HDMI receptacles are mounted on a printed circuit board ("PCB"). These receptacles are mounted so that the receptacles are parallel to the PCB. Mounting these HDMI receptacles parallel to the PCB is an inefficient use of the limited space of the PCB and of the interface of the device into which the receptacles are inserted. For example, additional space typically is included between adjacent receptacles so that a person's fingers can grasp an HDMI plug and remove or insert the plug into the receptacle without inadvertently removing or damaging an adjacent plug. This additional space is left unused on both the PCB and on the interface of the device into which the HDMI connectors are inserted.

Additionally, due to the generally rectangular cross-sectional shape of HDMI receptacles, a large portion of the receptacles are left uncovered by an electromagnetic shield when the receptacles are mounted parallel to the PCB. Electromagnetic shields for HDMI receptacles traditionally only cover those areas of the receptacles that are not adjacent to the PCB. When an HDMI receptacle is mounted parallel to the PCB, one of the two long sides of the rectangular-shaped receptacle is mounted adjacent to the PCB and, therefore, left unshielded from electromagnetic interference. As a result, data communicated through conventional receptacles may be more susceptible to electromagnetic interference.

Thus, a need exists for improved receptacles capable of communicating multimedia, data that, allow for more space-efficient, placement of the receptacles on a PCB. Moreover, a need exists for improved shielding of the receptacles to better protect the data communicated through the receptacles from electromagnetic interference.

BRIEF DESCRIPTION OF THE INVENTION

In one embodiment, a receptacle assembly for an electrical connector is provided. The assembly includes a housing, a plurality of electrical contacts and a shield. The housing includes a mating end and a mounting end that are orthogonal to each other. The mating end of the housing, is elongated along a longitudinal axis of the housing. The electrical contacts are held by the housing and extend between a mating end presented at the mating end of the housing and a mounting end configured to be mounted to a circuit board. The shield has a mating interface elongated along a longitudinal axis. The shield is configured to receive the electrical connector. The housing and the contacts are located within the shield. The longitudinal axes of the housing and the mating interface are orthogonal to the circuit board.

Optionally, the assembly includes a plurality of contact chicklets that house the electrical contacts. Each of these contact chicklets can include an alignment pin that aligns the assembly on the circuit board.

In another embodiment, an electrical contact device is provided. The device includes first and second contact chicklets. Each of the contact chicklets houses a set of electrical contacts. A mating end of each of the electrical contacts is configured to communicate with an electrical connector. A mounting end of each of the electrical contacts is configured to be mounted to a circuit board. The mating and mounting ends of the electrical contacts are perpendicular to each other.

Optionally, the device also includes a shield with a window and each of the contact chicklets includes a rib projection. The window is configured to receive the rib projections to secure the contact chicklets together.

DETAILED DESCRIPTION OF THE INVENTION

Figure 1:
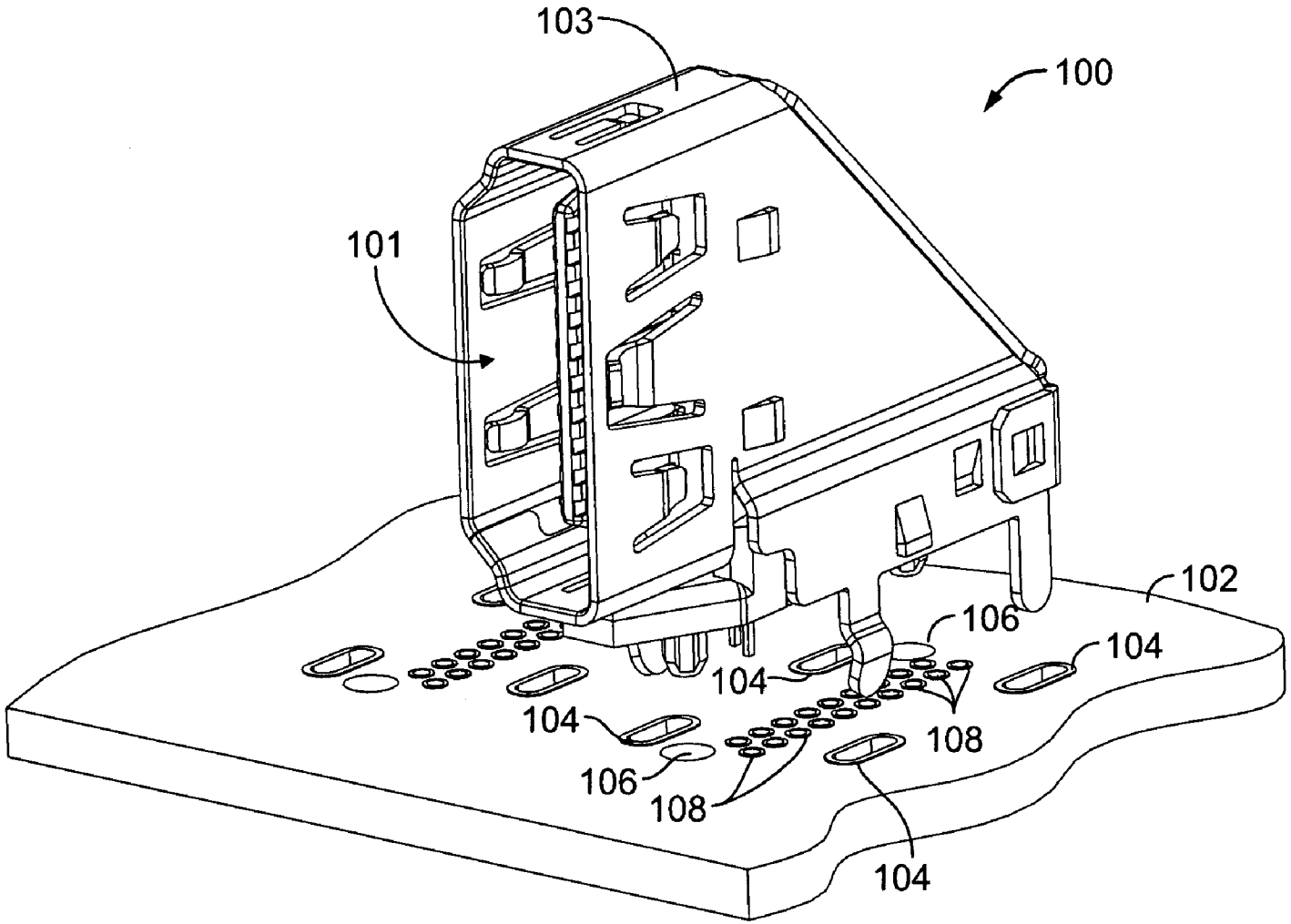
FIG. 1 is a perspective view of a vertically mounted receptacle in accordance with one embodiment.

FIG. 1 is a perspective view of a vertically mounted receptacle 100 in accordance with one embodiment. The receptacle 100 includes an opening 101 configured to receive an electrical connector or plug 240 (shown in FIG. 2). The receptacle 100 is mounted to a PCB 102. In one embodiment, the PCB 102 represents a circuit board other than a printed circuit board. The PCB 102 includes a plurality of shield pin holes 104, alignment pin holes 106 and electric contact holes 108. The electrical connector or plug 240 is capable of and configured to communicate multimedia data. For example, the plug 240 can be used to communicate audio, visual and auxiliary data. Examples of multimedia data include audiovisual signals such as digital television audiovisual signals between DVD players, set-top cable and satellite boxes and other audiovisual sources, on one hand, and television sets, projectors and other video displays, on the other hand. The multimedia data communicated by the plug 240 can include multichannel audio data as well as standard and high-definition consumer electronic video data. Moreover, the plug 240 also can communicate control and status information between a source and receiver of the multimedia data.

In one embodiment, the plug 240 is capable of communicating uncompressed digital streams comprising audio, video and/or auxiliary data across a plurality of TMDS channels. One example of the plug 240 is a High Definition Multimedia Interface ("HDMI") plug.

The receptacle 100 can be mounted to the PCB 102 using the plurality of holes 104, 106 and 108 so that the receptacle 100 is perpendicular to the PCB 102. As described below, other components of the receptacle 100 can be mounted to the PCB 102. For example, an electromagnetic shield 103 can be mounted to the shield pin holes 104 to shield the-receptacle 100 from electromagnetic interference. An organizer or contact chicklets can be mounted to the PCB 102 using the alignment pin holes 106 to align the receptacle 100 on the PCB 102. Electric contacts that communicate data through the receptacle 100 can be inserted into the electric contact holes 108. Additionally, once a plug 240 (shown in FIG. 2) is inserted into the opening 101 of the receptacle 100, the plug 240 can communicate with the PCB 102 using these contacts.

Figure 2A:
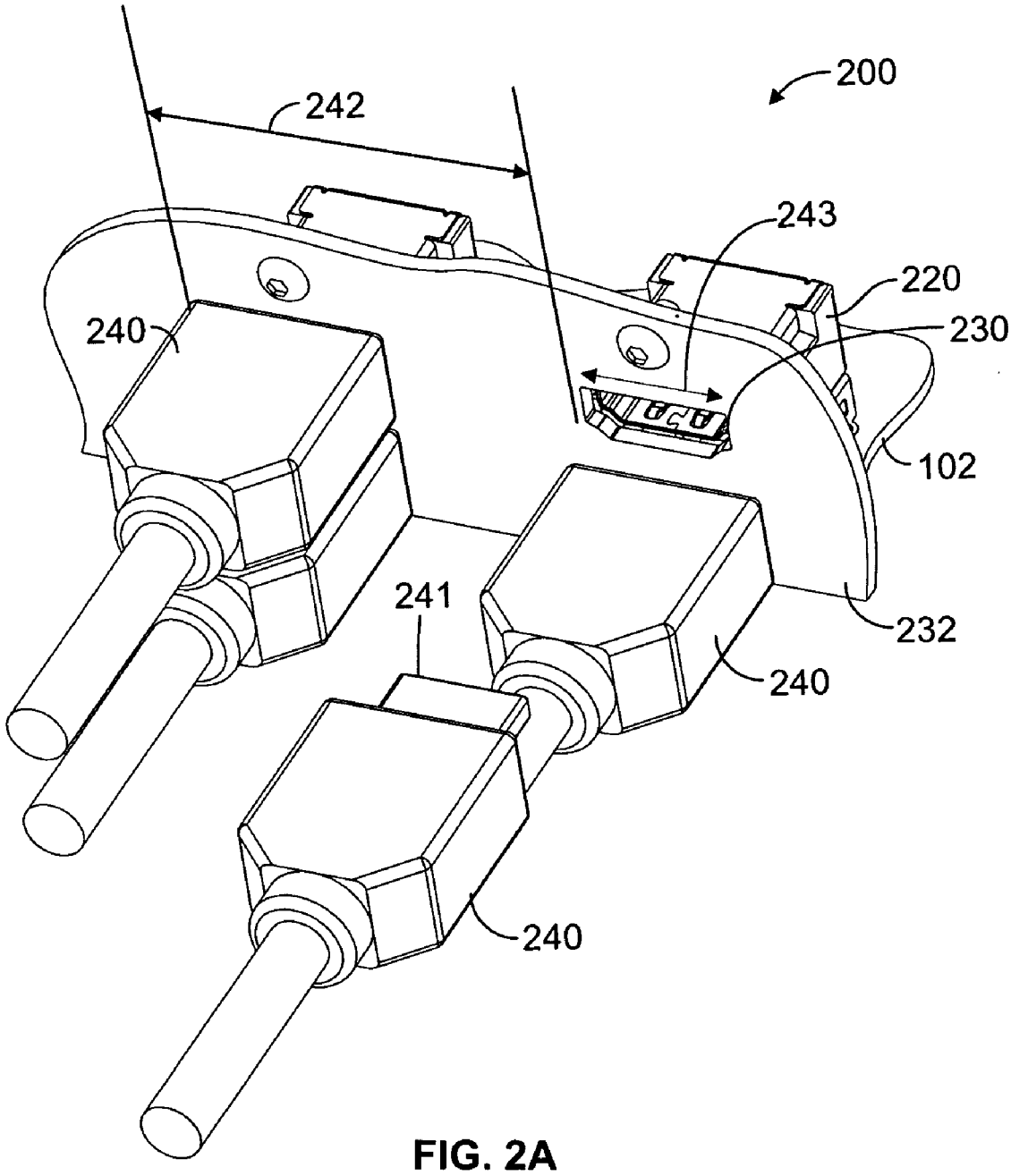
FIG. 2 includes perspective views a group of horizontally mounted receptacles and a group of vertically mounted receptacles.
Figure 2B:
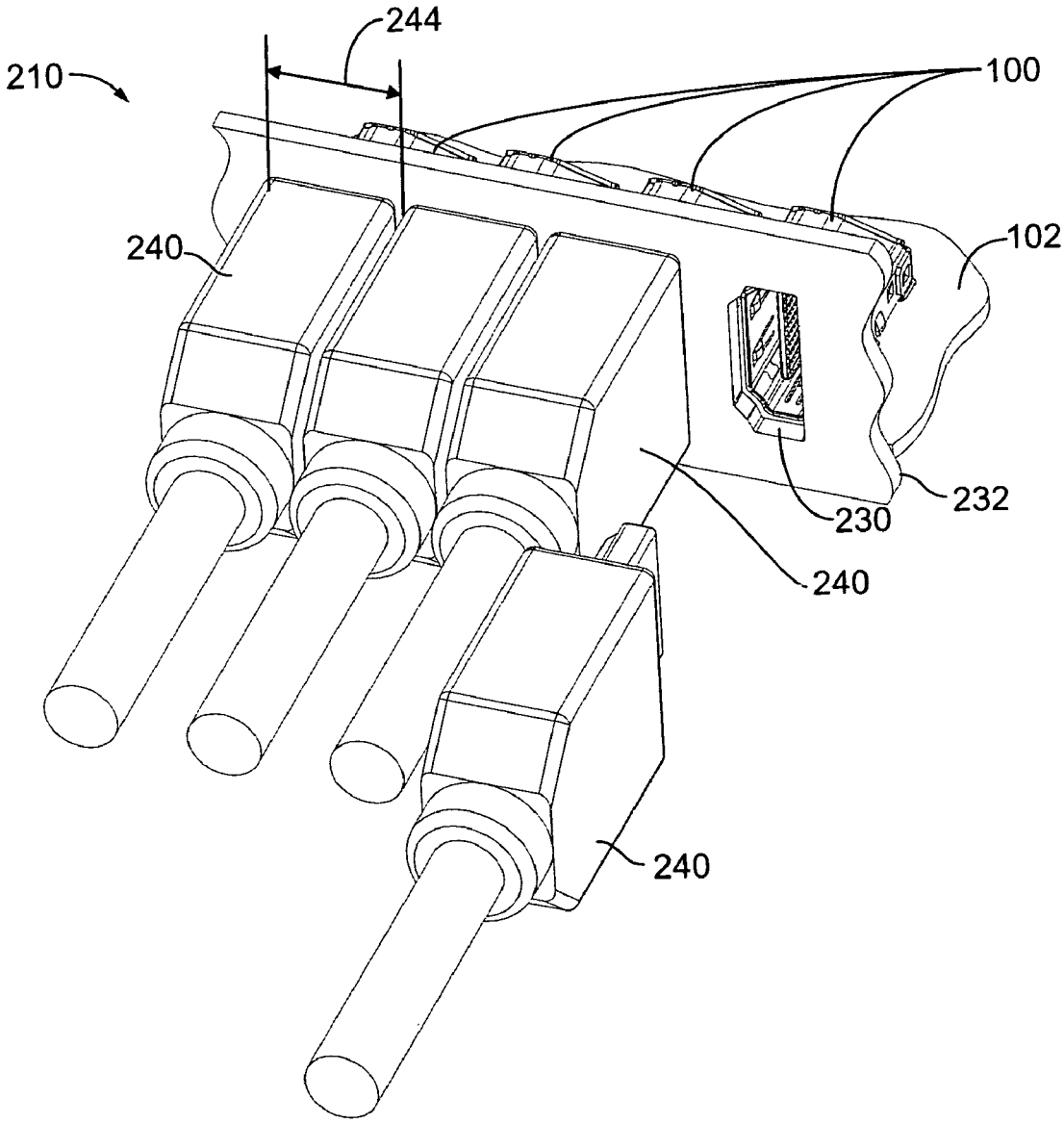

FIG. 2 includes perspective views of a group 200 of horizontally mounted stacked receptacles 220 and plugs 240 that are horizontally mounted to a PCB 102 and a group 210 of the receptacles 100 mounted to the PCB 102 in a vertical orientation. Each of the horizontally mounted stacked receptacles 220 in the stacked arrangement includes groups of two openings 230 configured to receive respective electrical connector plugs 240. Each of the plugs 240 is elongated across an end 241 of the plug 240. Each of the openings 230 also is elongated along one direction 243. The plug 240 is inserted into one of the openings 230 so that the elongated end 241 of the plug 240 is received by the elongated opening 230.

The group 210 of receptacles 100 is illustrated as mounted perpendicular to the PCB 102. A panel or component surface 232 is provided at the mating interface of the receptacles 100. Openings 230 in the panel surface 232 provide access to the openings 101 (shown in FIG. 1) of the receptacles 100. The plugs 240 are matable with the receptacles 100 through the panel openings 230.

FIG. 2 illustrates some of the differences between the horizontally mounted stacked receptacles 220 and the vertically mounted receptacles 100. For example, the horizontally mounted stacked receptacles 220 are connected to the PCB 102 so that the opening 230 for each receptacle 220 is elongated in the direction 243 that is parallel to the PCB 102. The plugs 240 are inserted into the openings 230 so that the elongated ends 241 of the plugs 240 are received by the elongated openings 230. As a result, the elongated ends 241 of the plugs 240 also are parallel to the PCB 102 when the plugs 240 are inserted into the openings 230 Conversely, the openings 230 for the vertically mounted receptacles 100 are elongated in a direction 245. In the illustrated embodiment, the direction 245 is substantially perpendicular to the PCB 102.

The footprint of each horizontally mounted stacked receptacle 220 on the PCB 102 is positioned a minimum pitch 242, or distance, away from neighboring horizontally mounted stacked receptacles 220 in order to provide enough space to accommodate a person's fingers so that he or she can grasp each plug 240 and insert or remove the plug 240 from an opening 230. That is, each receptacle 220 is a minimum horizontal distance away from its neighboring receptacles 220. As a result, the horizontally mounted stacked receptacles 220 waste a significant amount of space.

For example, some horizontally mounted stacked receptacles 220 have a pitch 242 of at least approximately 39.0 millimeters. Yet, reducing the pitch 242 of the horizontally mounted stacked receptacles 220 may make it more difficult for a person to grasp a single plug 240 and remove the plug 240 from a horizontally mounted stacked receptacle 220. Additionally, placing the horizontally mounted stacked receptacles 220 closer together could increase the risk that a person attempting to remove one plug 240 accidentally removes a neighboring plug 240 or damages a neighboring horizontally mounted stacked receptacle 220.

In contrast, the vertically mounted receptacles 100 use less space for the same number of receptacles 100 and openings 230, and use less real estate on the PCB 102. The pitch 244 of the vertically mounted receptacles 100 can be much less than that of the horizontally mounted stacked receptacles 220. For example, the pitch 244 of the vertically mounted receptacles 100 can be approximately 12.5 millimeters. As a result, the group 210 of the vertically mounted receptacles 100 is more densely packed than the group 200 of the horizontally mounted stacked receptacles 220. Additionally, while the vertically mounted receptacles 100 can be more densely packed in a given amount of space, a person can still easily insert and remove the plugs 240 because he or she can grasp the top and bottom of a plug 240 without accidentally removing a neighboring plug 240 or damaging a neighboring receptacle 100.

Figure 3:
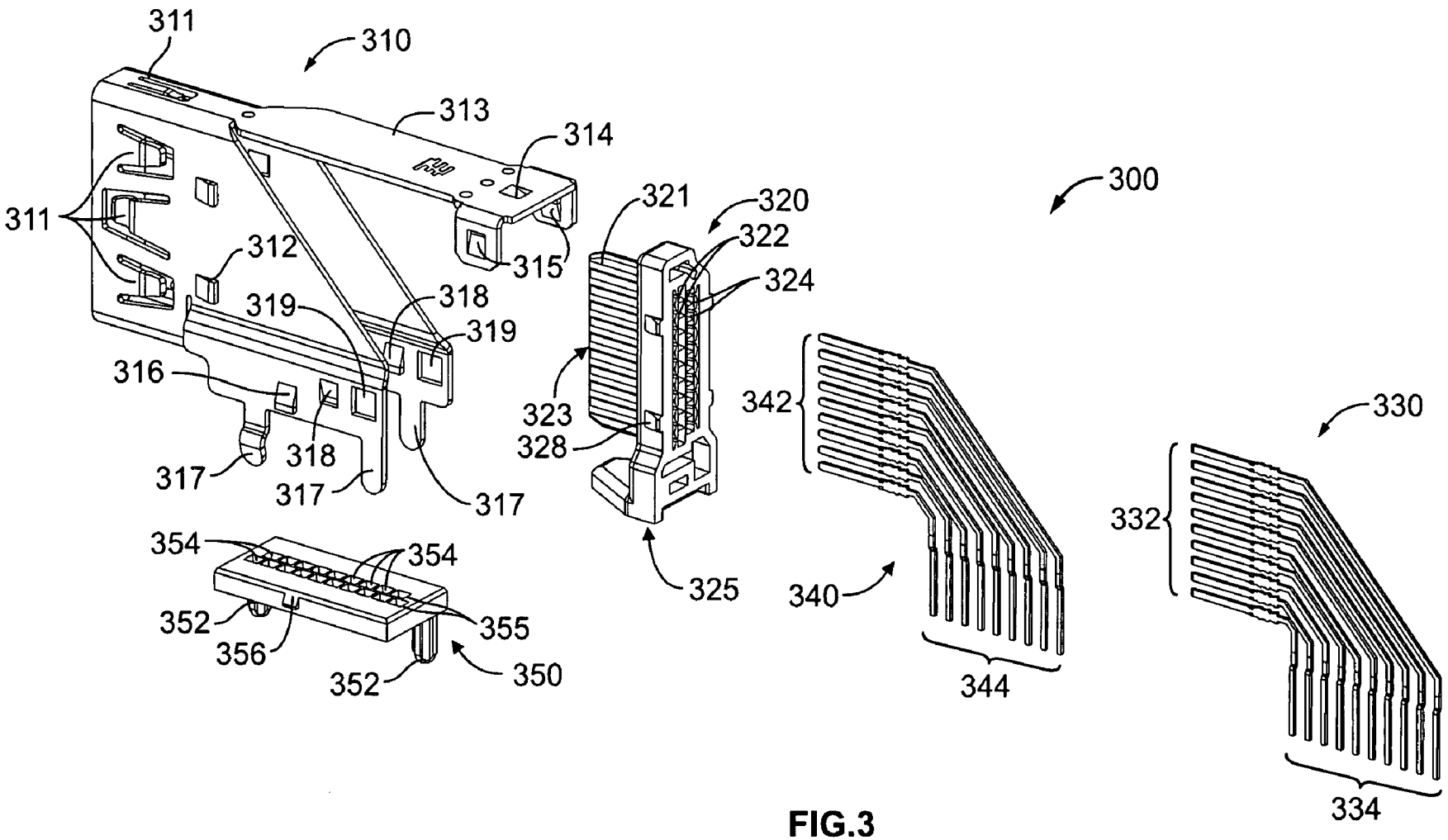
FIG. 3 is an exploded view of the vertically mounted receptacle.

FIG. 3 is an exploded view of a vertically mounted receptacle 300. The receptacle 300 includes a shield 310, a housing 320, a set of odd electrical contacts 330, a set of even electrical contacts 340 and a contact organizer 350. Generally, the shield 310 surrounds the housing 320, the odd and even electrical contacts 330 and 340, and the contact organizer 350 in the receptacle 300 while also shielding these components from electromagnetic interference.

The shield 310 includes a plurality of spring fingers 311, one or more first securing projections 312, a back plate 313, a first retaining indentation 314, a plurality of closure indentations 315, one or more second securing projections 316, a plurality of shield pins 317, one or more second retaining indentations 318 and a plurality of windows 319. The shield 310 can be formed of a single piece of conductive material, such as a metal, by a stamping and or forming process. Alternatively, the shield 310 may include multiple pieces coupled together. In an embodiment, the shield 310 is a rigid body.

The spring fingers 311 are flexible and slightly extend into the volume inside the shield 310. The spring fingers 311 contact the portion of the plug 240 (shown in FIG. 2) that is inserted into the receptacle 300. The spring fingers 311 provide a frictional force on the plug 240 that holds the plug 240 in the receptacle 300 during normal use.

The first securing projections 312 secure and retain the housing 320 once the housing 320 is inserted into the shield 310, as described below. The back plate 313 closes the back of the shield 310 and surrounds the odd and even electrical contacts 330 and 340, the housing 320 and the organizer 350 inside the shield 310. The closure indentations 315 snap or lock into the windows 319 to keep the back plate 313 in place once the back plate 313 has been bent to close the shield 310. The shield pins 317 are used to mount the receptacle 300 on the PCB 102 (shown in FIG. 1). The shield pins 317 can be straight or can include a bend to help prevent the receptacle 300 from accidentally being removed from the PCB 102 (shown in FIG. 1) during the process of securing the receptacle 300 to the PCB 102. For example, the shield pins 317 may be bent to prevent the receptacle 300 from being removed from the PCB 102 during the process of soldering the shield pins 317 onto the PCB 102.

The housing 320 includes a first set of holes 322, a second set of holes 324, and one or more securing projections 328. In an embodiment, the housing 320 is a rigid body. The housing 320 can be formed of a single piece of dielectric material. The first and second sets of holes 322 and 324 are aligned in two rows along the longitudinal axis of the housing 320 and hold the odd and even electrical contacts 330 and 340 within the housing 320 for mating engagement with mating contacts of the plug 240 (shown in FIG. 2). The securing projections 328 connect with the first securing projections 312 of the shield 310 to hold the housing 320 in place.

Each of the odd and even electrical contacts 330 and 340 includes a mating end 332 and 342, respectively, and a mounting end 334 and 344, respectively. The mating ends 332 and 342 are mated with the mating contacts of the plug 240 (shown in FIG. 2). The mounting ends 334 and 344 are mounted to the PCB 102 (shown in FIG. 1). The mating ends 332 and 342 are oriented at approximately ninety degrees, or at a right angle, with respect to the mounting ends 334 and 344.

The contacts 330 and 340 are capable of communicating electrical signals or data between the plug 240 (shown in FIG. 2) and the PCB 102 (shown in FIG. 1) through the receptacle 300. In one embodiment, the contacts 330 and 340 comprise signal paths configured to communicate multimedia data such as audiovisual signals, digital television signals, multichannel audio signals, standard consumer electronic video data, and high definition consumer electronic video data, and the like, as well as control and status information. For example, the contacts 330 and 340 can be configured to communicate uncompressed digital streams comprising audio, video and/or auxiliary data across a plurality of TMDS channels.

In one embodiment, the odd electrical contacts 330 correspond to, and communicate data from, the odd numbered connector pin assignments for an HDMI plug that is used as the plug 240 (shown in FIG. 2). Similarly, the even electrical contacts 340 correspond to, and communicate data from, the even numbered connector pin assignments for an HDMI plug used as the plug 240 (shown in FIG. 2).

The odd electrical contacts 330 are configured to match up with and pass through the first set of holes 322 in the housing 320. As a result, when the odd electrical contacts 330 are inserted into the housing 320, the mating end 332 of the odd electrical contacts 330 can pass through the first set of holes 322 and be exposed on a tongue 321 of the housing 320. The tongue 321 extends along the longitudinal axis of the housing 320 on a mating side 323 of the housing 320.

In a similar manner, the even electrical contacts 340 are configured to match up with and pass through the second set of holes 324 in the housing 320. When the even electrical contacts 340 are inserted into the housing 320, the mating end 342 of the even electrical contacts 340 can pass through the second set of holes 324 and be exposed on the tongue 321 of the housing 320.

The contact organizer 350 includes one or more alignment pins 352, a plurality of organizing holes 354, and one or more securing projections 356. In an embodiment, the contact organizer 350 is a rigid body. The alignment pins 352 align the receptacle 300 on the PCB 102 (shown in FIG. 1). The organizing holes 354 organize and hold each of the odd electrical contacts 330 and even electrical contacts 340 and align the contacts 330 and 340 with the corresponding holes 108 in the PCB 102 (shown in FIG. 1). In the illustrated embodiment, the organizing holes 354 are arranged in a pair of rows 355. In another embodiment, the organizing holes 354 are arranged in a different number of rows 355. In another embodiment, the organizing holes 354 are arranged in a pattern other than one or more rows 355. The securing projections 356 hold the organizer 350 in the shield 310 once the organizer 350 is inserted into the shield 310.

Figure 4A:
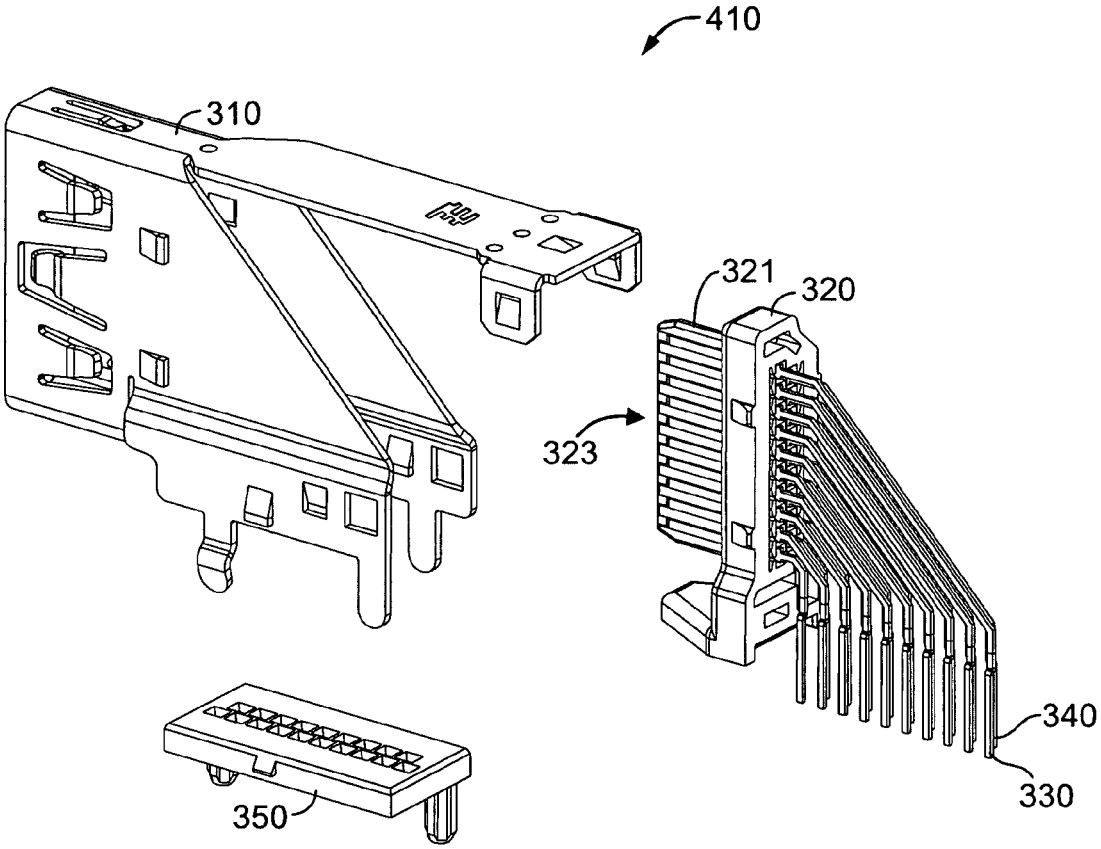
FIGS. 4A, 4B, 4C and 4D illustrate the vertically mounted receptacle shown in FIG. 3 at various stages of assembling the receptacle.

FIGS. 4A, 4B, 4C and 4D illustrate the vertically mounted receptacle 300 at various stages of assembling the receptacle 300. First, as shown in FIG. 4A, at stage 410 each of the sets of odd and even numbered electrical contacts 330 and 340 are inserted into the sets of holes 322 and 324 (shown in FIG. 3) in the housing 320. For example, each of the odd electrical contacts 330 is inserted into and through one of the holes 322 of the housing 320 and each of the even electrical contacts 340 is inserted into and through one of the holes 324 in the housing 320. Once the odd and even contacts 330 and 340 are inserted through these holes 322 and 324, the mating ends 332 and 342 (shown in FIG. 3) of the odd and even contacts 330 and 340 are exposed on the mating side 323 of the housing 320 at the tongue 321 of the housing 320.

Figure 4B:
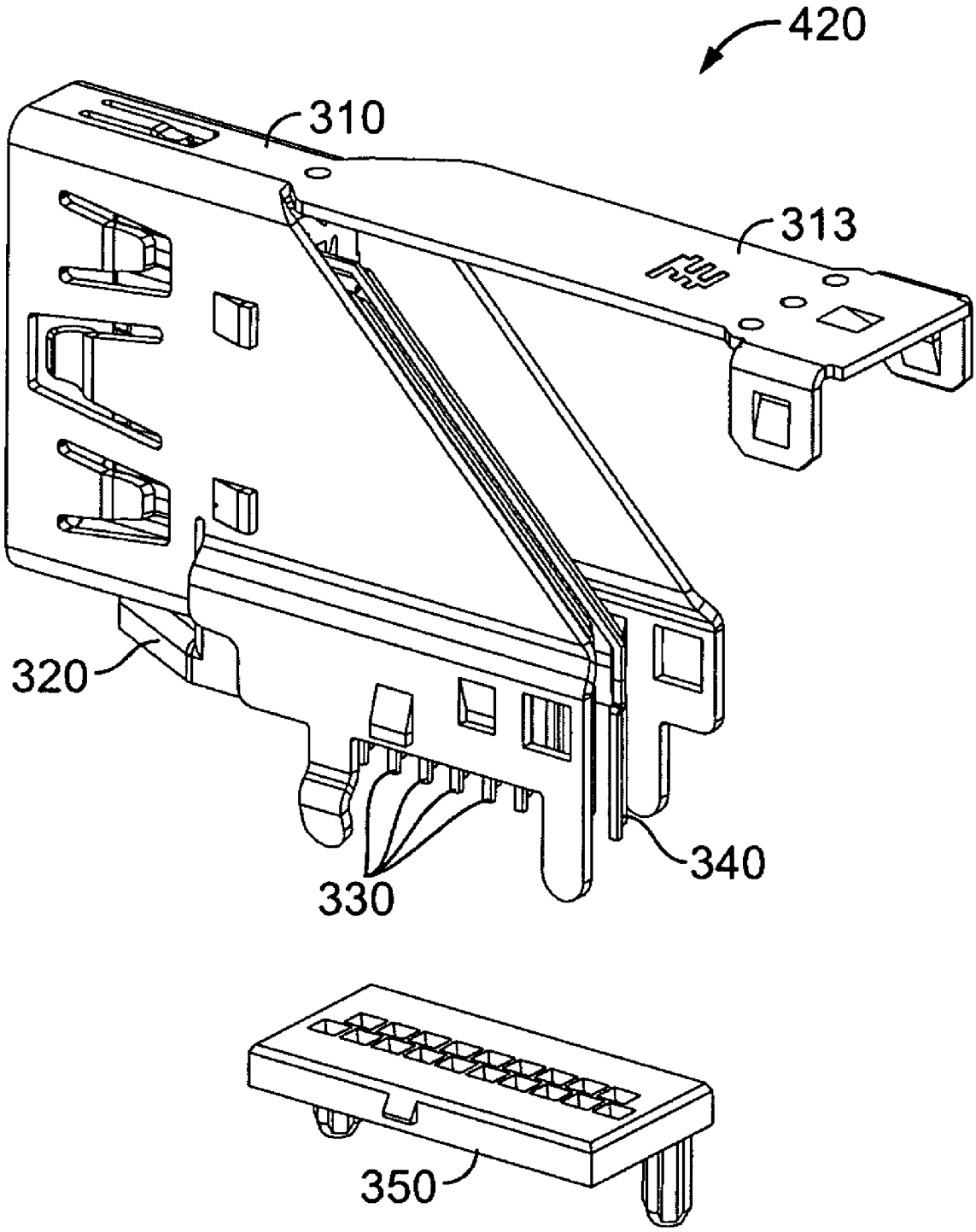

Next, as shown in FIG. 4B, at stage 420 the combination of the housing 320, the odd electrical contacts 330 and the even electrical contacts 340 are inserted into the shield 310. This combination is inserted into the shield 310 until the securing projections 328 (shown in FIG. 3) on each side of the housing 320 are inserted into or match up with the first securing projections 312 on the shield 310. Each of the securing projections 328 matches up with and provides a snap fit connection to, the inside part of the first securing projections 312 on the shield 310.

Figure 4C:
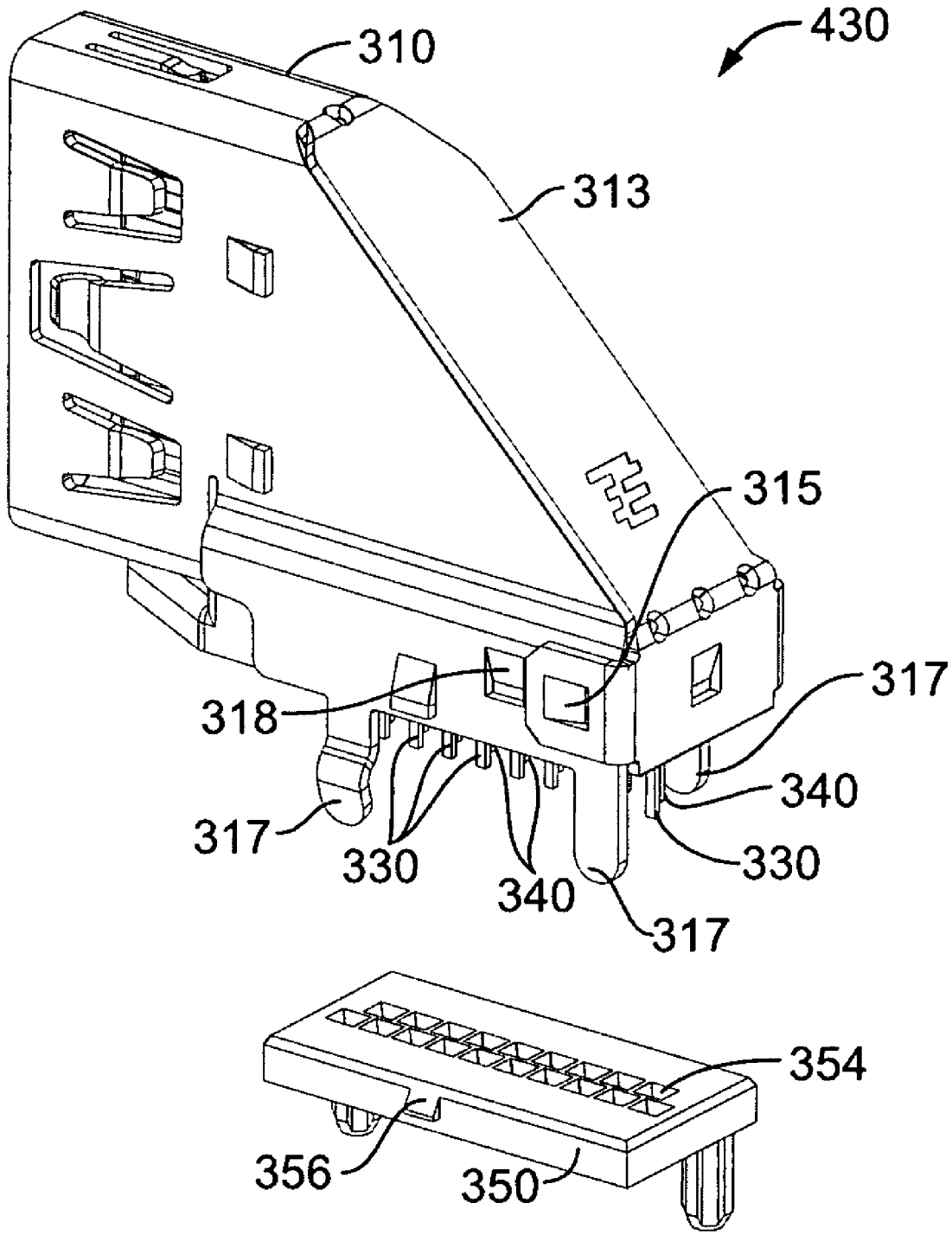

Next, as shown in FIG. 4C, at stage 430 the back panel 313 of the shield 310 is bent and lowered towards the opening of the shield 310 nearest the shield pins 317. The back panel 313 is bent along the contours of the shield 310 until the closure indentations 315 on each side of the back panel 313 are inserted into the windows 319 (shown in FIG. 3). That is, the back panel 313 is bent until the portions of the closure indentations 315 on the inside of the shield 310 are inserted into the windows 319. Once the closure indentations 315 are inserted into the windows 319, a snap fit connection between these features prevents the back panel 313 from returning its original position.

Figure 4D:
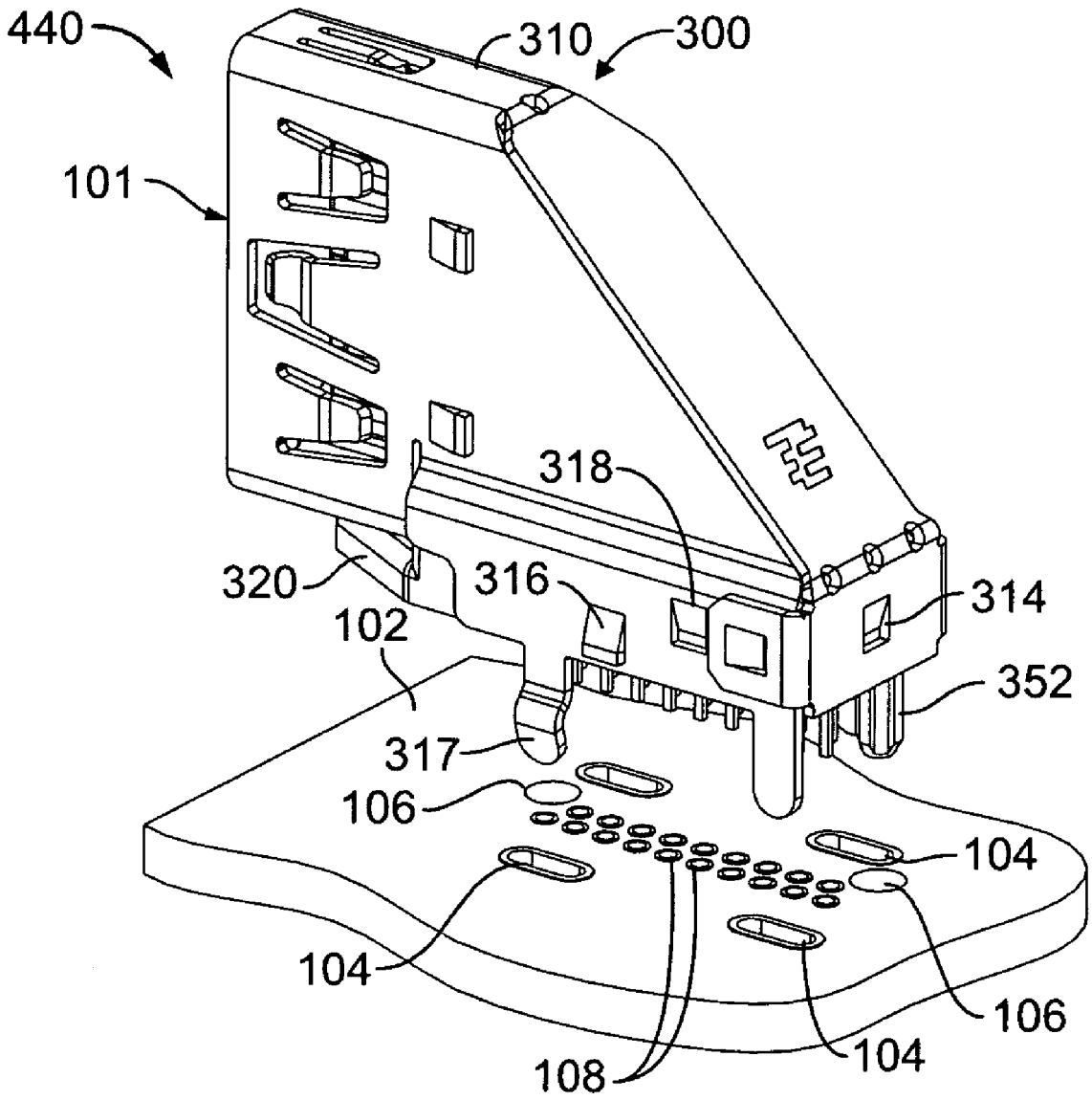

Next, as shown in FIG. 4D, at stage 440 the organizer 350 (shown in FIG. 4C) is inserted into the shield 310. The organizer 350 is placed adjacent to a mounting side 325 (shown in FIG. 3) of the housing 320. The mounting side 325 of the housing 320 is perpendicular to the mating side 323 of the housing 320 (shown in FIG. 3). Each of the odd and even contacts 330 and 340 (shown in FIG. 4C) can be inserted into and through a corresponding organizing hole 354 (shown in FIG. 4C) in the organizer 350. Once these contacts 330 and 340 are inserted, the mounting ends 334 and 344 (shown in FIG. 3) of the contacts 330 and 340 are exposed on a bottom side of the organizer 350.

In one embodiment, the organizer 350 is connected to the shield 310. The organizer 350 can be inserted into the shield 310 until the securing projections 356. (shown in FIG. 4C) on the organizer 350 match up with, or are inserted into, the second securing projections 316 in the shield 310. The securing projections 356 and, second securing projections 316 secure the organizer inside the shield 310 in one embodiment.

The first and second retaining indentations 314 and 318 can prevent the organizer 350 from moving too far inside the shield 310. For example, once the organizer 350 is inserted into the shield 310, the indentations 314 and 318 contact the top of the organizer 350. These indentations 314 and 318 then prevent the organizer 350 from moving farther up into the shield 310 and potentially damaging the odd and/or even contacts 330, 340.

After stage 440, the receptacle 300 can be mounted to the PCB 102 to enable communication between the plug 240 (shown in FIG. 2) and the PCB 102. The receptacle 300 can be inserted into the PCB 102 by inserting the shield pins 317 into the shield pin holes 104 in the PCB 102, and the alignment pins 352 of the organizer 350 into the alignment pin holes 106 in the PCBA 102.

The mounting ends 334 and 344 of the odd and even electrical contacts 330 and 340 are inserted into the electric contact holes 108 in PCB 102. These contact holes 108 provide communication between the odd and even electrical contacts 330 and 340 and one or more devices or components connected to or mounted on the PCB 102.

In operation, the plug 240 (shown in FIG. 2) is inserted into the opening 101 of the receptacle 300. The receptacle 300 communicates data between the plug 240 and the PCB 102 through the contacts 330 and 340. The contacts 330 and 340 pass from a first side of the receptacle 300 at the opening 101, bend approximately ninety degrees inside the receptacle 300, and then penetrate through the organizer 350.

The shield 310 blocks or shields the contacts 330, 340 from electromagnetic interference. For example, the shield 310 can be formed of a conductive material which is then grounded via the shield pins 317 that are connected to the shield pin holes 104 of the PCB 102.

As described above, one or more of the shield pins 317 optionally can include a bend if the shield pins 317 with a bend are inserted into the shield pin holes 104 in the PCB 102, the bend can help to prevent or impede accidental removal of the receptacle 300 from the PCB 102 prior to soldering the shield pins 317 in the shield pin holes 104.

Additionally, the alignment pins 352 of the organizer 350 can be inserted into the alignment pin holes 106 in the PCB 102 to properly line up and orient the receptacle 300. Optionally, the alignment pins 352 are longer than the extent of the mounting ends 334 and 344 of the odd and even contacts 330 and 340 that protrude from the bottom side of the organizer 350. In such an embodiment, the alignment pins 352 enter the alignment pin holes 106 to align the mounting ends 334 and 344 of the contacts 330 and 340 with the holes 108 in the PCB 102 before the mounting ends 334 and 344 are inserted into the holes 108.

Figure 5:
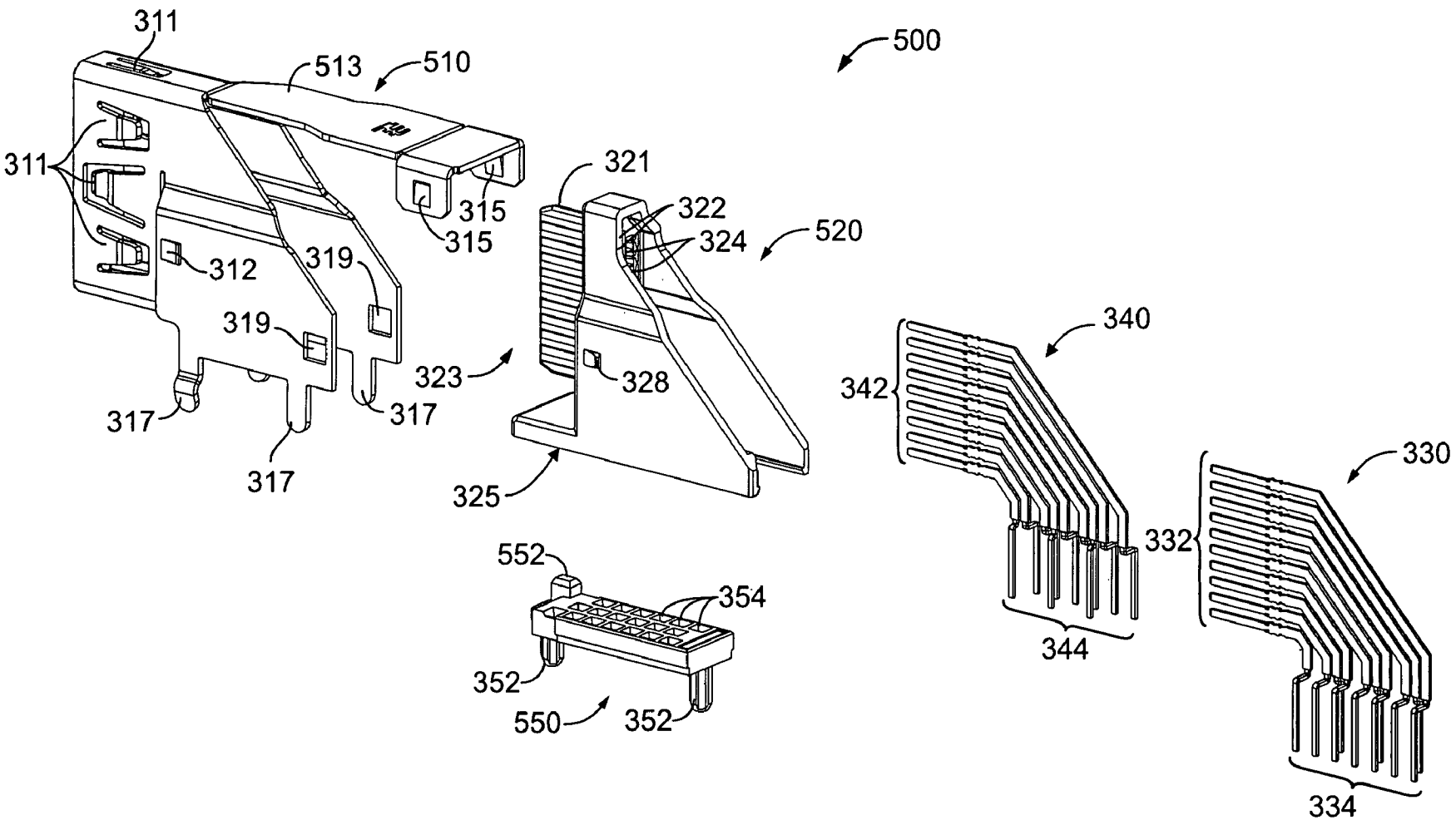
FIG. 5 is an exploded view of an alternative receptacle with an extended housing.

FIG. 5 is an exploded view of an alternative receptacle 500 with an extended housing 520. In this embodiment the receptacle 500 includes a shield 510, the extended housing 520, the set of odd contacts 330, the set of even contacts 340 and a contact organizer 550.

The receptacle 500 is similar to the receptacle 300 described above and shown in FIGS. 3 and 4, with a few differences. First, the housing 520 of the receptacle 500 extends farther back towards the odd and even contacts 330 and 340 when compared to the housing 320 of the receptacle 300. The extended housing 520 provides additional protection to the odd and even contacts 330 and 340. In an embodiment, the housing 520 is a rigid body.

Second, a back plate 513 of the shield 510 is similar to the back plate 313 of the shield 310 (shown in FIG. 3) except that the back plate 513 does not include the retaining indentation 314 (shown in FIG. 3). Instead, the back plate 513 only includes the closure indentations 315. Alternatively, the back plate 513 can include the retaining indentation 314.

Third, an organizer 550 of the receptacle 500 includes a securing pin 552 and the housing 520 includes a matching hole or indentation on the mounting aside 325 of the housing 520. In one embodiment, the organizer 550 is a rigid body. The securing pin 552 can fit into and provide a connection to the hole or indentation in the mounting side 325 of the housing 520. The connection between the securing pin 552 and the housing 520 can be a snap fit connection that secures the organizer 550 to housing 520.

Figure 6A:
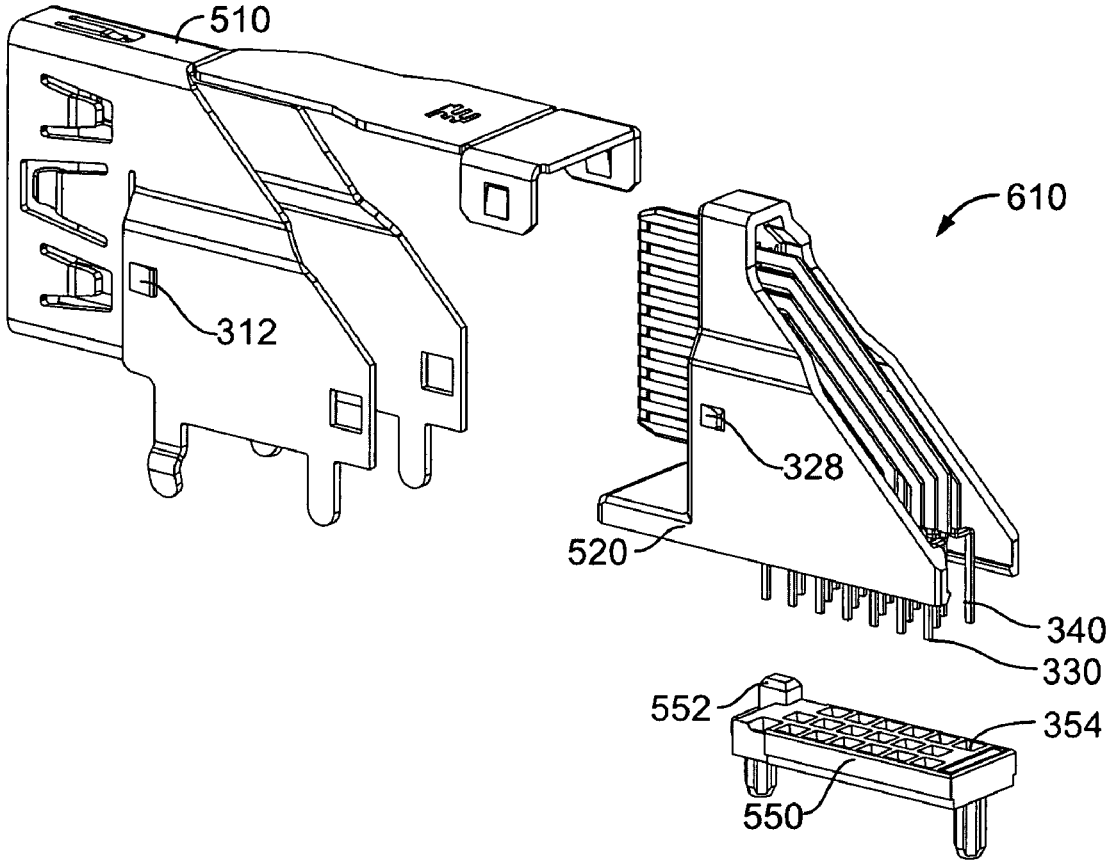
FIGS. 6A, 6B, 6C and 6D illustrate the receptacle shown in FIG. 5 at various stage of assembling the receptacle.

FIGS. 6A, 6B, 6C and 6D illustrate the vertically mounted receptacle 500 shown in FIG. 5 at various stage of assembling the receptacle 500. First, as shown in FIG. 6A, at stage 610 the mating ends 332 and 342 (shown in FIG. 5) of the odd and seven numbered electrical contacts 330 and 340 are inserted into the holes 322 and 324 (shown in FIG. 5) in the housing 520. For example, each of the odd electrical contacts 330 is inserted into and through one of the holes 322 (shown in FIG. 5) of the housing 520 and each of the even electrical contacts 340 is inserted into and through one of the holes 324 (shown in FIG. 5) in the housing 520. Once the odd and even contacts 330 and 340 are inserted through these holes 322 and 324, the mating ends 332 and 342 (shown in FIG. 3) of the odd and even contacts 330 and 340 are exposed on the mating side 323 (shown in FIG. 5) of the housing 520 at the tongue 321 (shown in FIG. 5) of the housing 520.

Figure 6B:
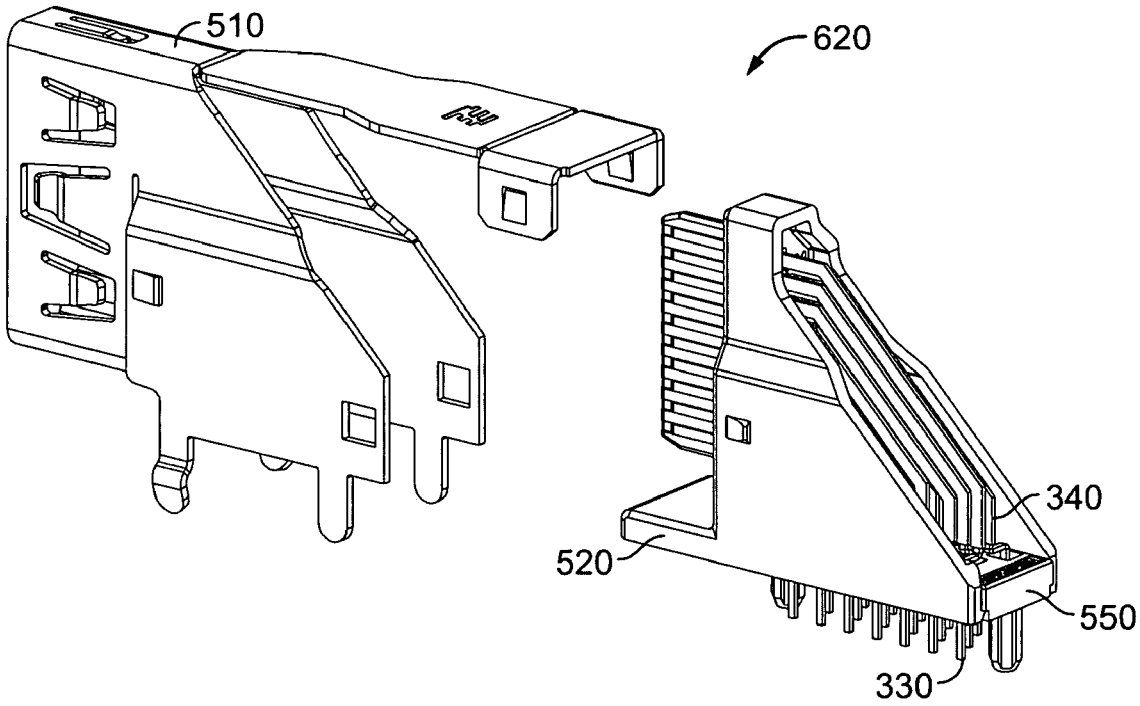

Next, as shown in FIG. 6B, at stage 620 the organizer 550 is inserted into the housing 520. The mounting ends 334 and 344 (shown in FIG. 5) of the odd and even contacts 330 and 340 are inserted through the holes 354 (shown in FIG. 6A) in the organizer 550.

The organizer 550 connects with the housing 520. For example, the organizer 550 can be inserted into the housing 520 so that the securing pin 552 (shown in FIG. 6A) of the organizer 550 connects with a hole or other opening of the housing 520. The securing pin 552 can provide a snap fit connection between the organizer 550 and the housing 520.

Figure 6C:
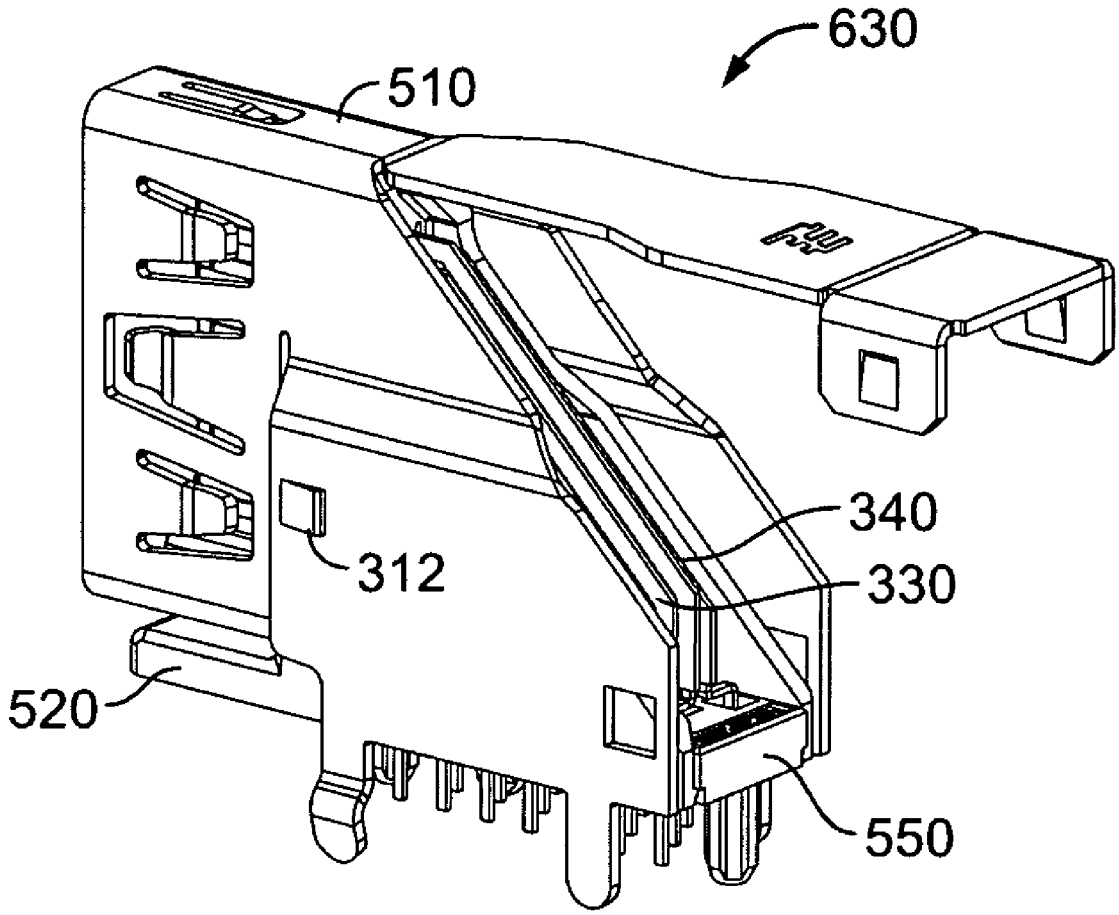

Next, as shown in FIG. 6C, at stage 630 the combination of the housing 520, the odd electrical contacts 330, the even electrical contacts 340 and the organizer 550 are inserted into the shield 510. This combination is inserted into the shield 510 until the securing projections 328 (shown in FIG. 6A) on each side of the housing 520 are inserted into or attach up with the first securing projections 312 on the shield 510. For example, each securing projection 328 on the housing 520 may match up with, and provide a snap fit connection to, the first securing projections 312 on the shield 510.

Figure 6D:
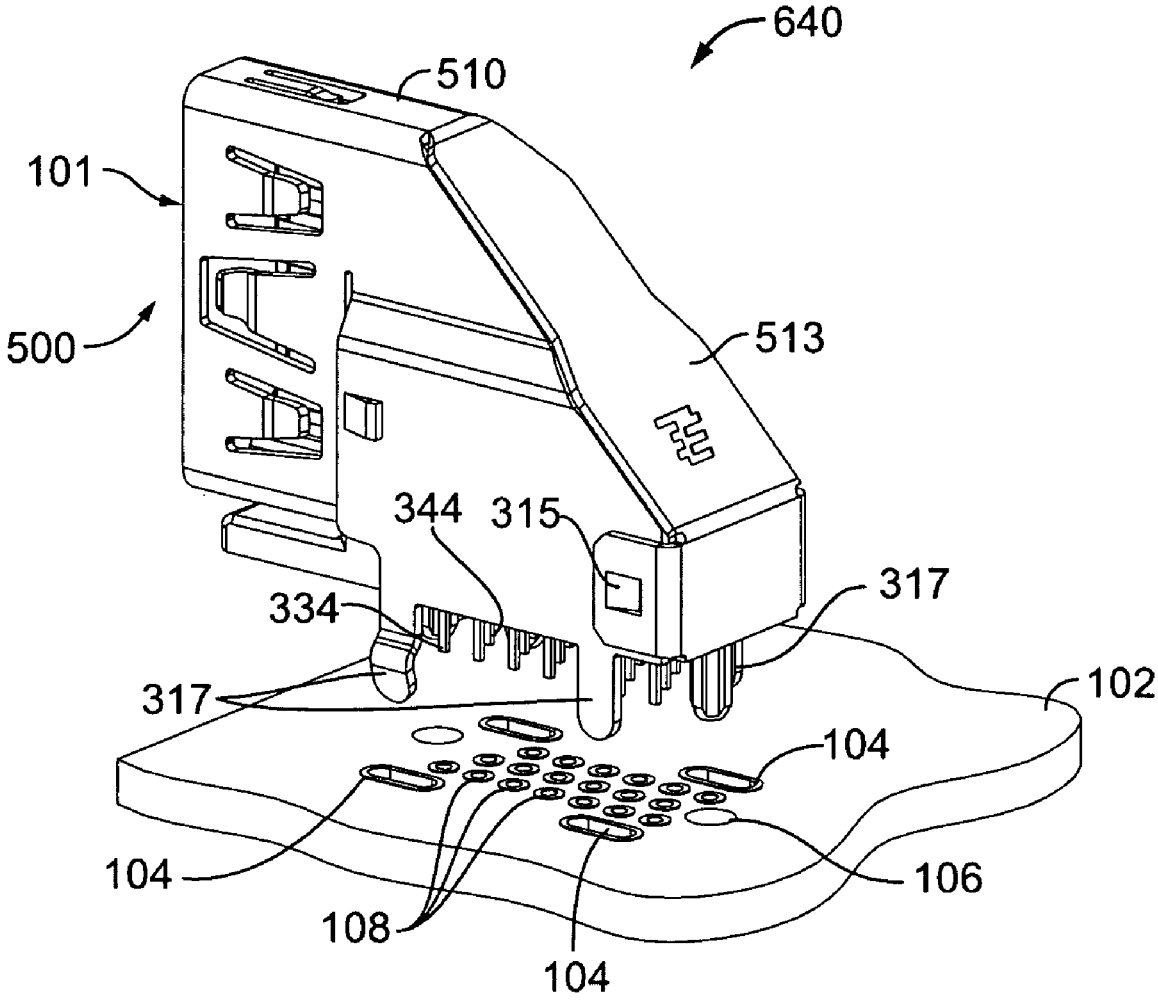

Next, as shown in FIG. 6D, at stage 640 the back panel 513 of the shield 510 is bent and lowered towards the shield pins 317. The back panel 513 is bent until the closure indentations 315 on each side of the back panel 513 are inserted into the windows 319 (shown in FIG. 5). After stage 640, the receptacle 500 can mounted to the PCB 102 by inserting the shield pins 317 and the mounting ends 334, 344 of the even and odd contacts 340, 330 into matching shield pin holes 104 and contact holes 108, respectively, to permit communication between an HDMI plug 240 (shown in FIG. 2) and the PCB 102 via the receptacle 500.

Figure 7:
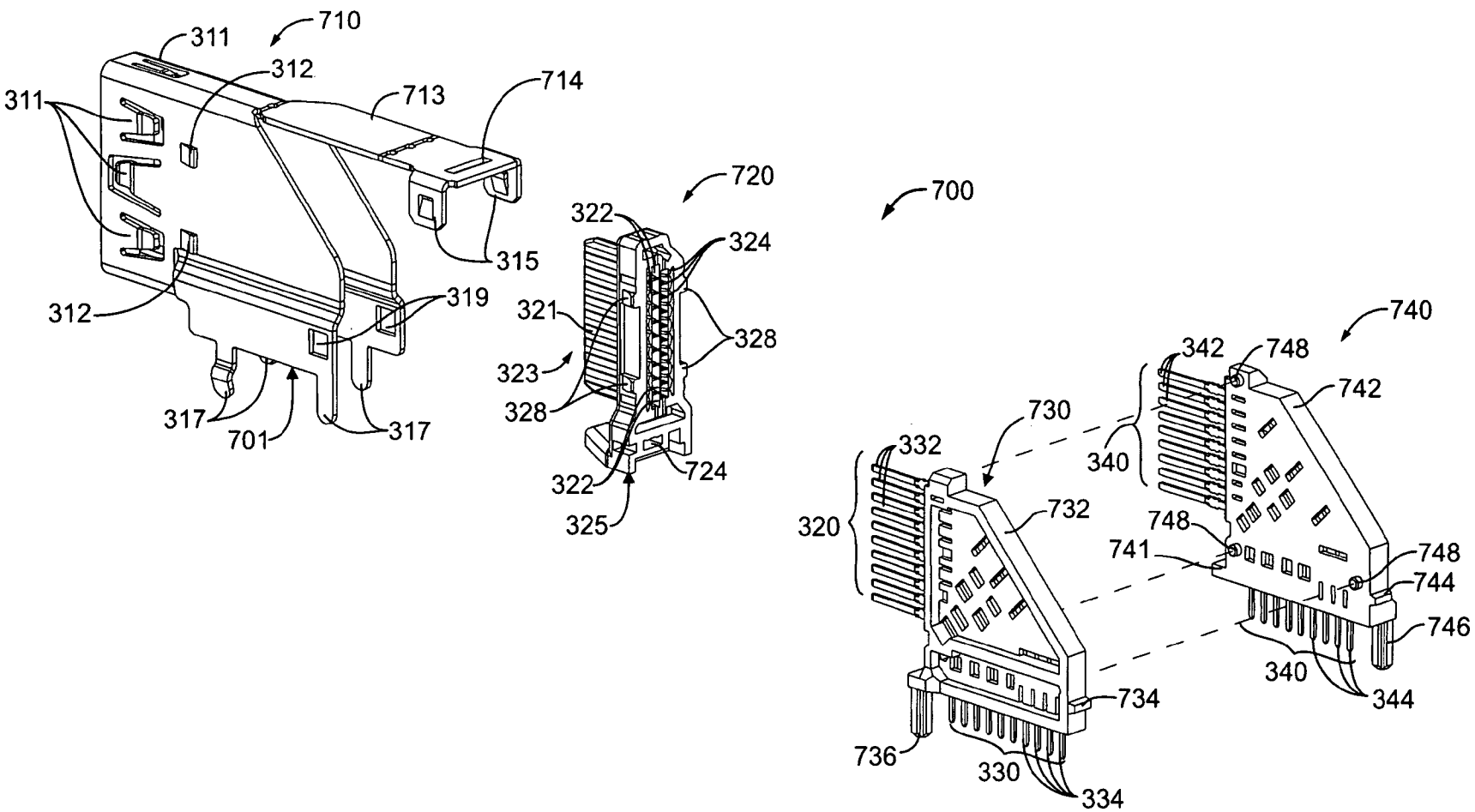
FIG. 7 is an exploded view of another alternative receptacle with two contact chicklets.

FIG. 7 is an exploded view of another alternative receptacle 700 with two contact chicklets 730 and 740. In this embodiment, the receptacle 700 includes a shield 710, a housing 720, and two contact chicklets 730 and 740. In one embodiment, each of the contact chicklets 730 and 740 is lead-frame that has been insert molded. In another embodiments the contact chicklets 730, 740 may be a pair of lead-frames that are insert molded as a single piece.

The shield 710 includes the spring fingers 311, a plurality of the securing projections 312, a back plate 713, a window 714 in the back plate 713, a pair of closure indentations 315, a plurality of shield pins 317 and a pair of windows 319. The shield 710 can be formed of a single piece of conductive material, such as a metal, by a stamping and/or forming process. Alternatively, the shield 710 may include multiple pieces coupled together. In an embodiment, the shield 710 is a rigid body.

The spring fingers 311, shield pins 317 and windows 319 are described above. The securing projections 312 secure the housing 720 once the housing 720 is inserted into the shield 710. The back plate 713 closes the back of the receptacle 700 and retains the housing 720 and the odd and even contact chicklets 730 and 740 inside the shield 710. The closure indentations 315 are inserted into and connect with the windows 319 to hold the back plate 713 in place once the receptacle 700 is assembled. A pair of odd and even rib projections 734 and 744 on the contact chicklets 730 and 740 (described below) are received in the window 714 in the back plate 713 also to hold the back plate 713 in place and/or to hold the chicklets 730 and 740 together.

The housing 720 includes the two sets of holes 322 and 324, a retaining slot 724 and a plurality of the securing projections 328. The retaining slot 724 is an opening on the lower half of the housing 720. A retaining tab on one or more of the odd and even contact chicklets 730 and 740 (such as the tab 741 on the even contact chicklet 740) can be inserted into the slot 724 in housing 720 to help retain and align the odd or even contact chicklet 730 or 740 with respect to the housing 720. In an embodiment, the housing 720 is a rigid body. The securing projections 328 match up with and fit into the inside of the securing projections 312 on the shield 710. That is, each of the securing projections 328 on the housing 720 matches up with, and can provide a snap fit connection to, a securing projection 312 on the shield 710.

The even contact chicklet 740 includes a body 742, the set of even electrical contacts 340, the even rib projection 744, one or more securing pins 748, an alignment pin 746, and the retaining tab 741. The even contact chicklet body 742 houses and protects the even electrical contacts 340 as the even electrical contacts 340 pass through the even contact chicklet 740. In an embodiment, the chicklet body 742 is a rigid body.

The even contact chicklet body 742 can align the mating end 342, of the even contacts 340 so that the even contacts 340 match up with a set of holes 324 in the housing 720 (described below) and with the contact holes 108 in the PCB 102 (shown in FIG. 1). For example, the even contact chicklet body 742 can replace the function of the organizer 350 or 550 in the embodiments described above by lining up the mounting end 344 of the even contacts 340 with the, electric contact holes 108 in the PCB 102.

The even rib projection 744 is inserted into the window 714 in the back plate 713 of the shield 710 during assembly. In an embodiment, approximately half of the window 714 receives the even rib projection 744 when the even rib projection 744 is inserted into the window 714.

The securing pins 748 connect the even contact chicklet 740 with the odd contact chicklet 130. For example, each of the securing pins 748 can match up with a matching hole or indentation on the odd contact chicklet 730 and hold the even and odd contact chicklets 740 and 730 together through a friction fit. The alignment pin 746 is inserted into a corresponding alignment hole 106 in the PCB 102 to align the receptacle 700 on the PCB 102.

The retaining tab 741 is inserted into the retaining slot 724 in the housing 720. The retaining tab 741 secures the even contact chicklet 740 and prevents the even contact chicklet 740 from moving with respect to the housing 720.

The odd contact chicklet 730 includes a body 732, the set of electrical connections or contacts 330, an alignment pin 736, and an odd rib projection 734. The odd contact chicklet body 732 houses and protects the odd electrical contacts-330 as the odd contacts 330 pass through the odd-contact chicklet 730. The odd contact chicklet body 732 includes passages or holes through which the contacts 330 pass. In an embodiment, the chicklet body 732 is a rigid body.

The odd contact chicklet body 732 aligns the mating end 332 of the odd contacts 330 so that the odd contacts 330 match up with a set of holes 322 in the housing 720 (described below). The odd contact chicklet body 732 also aligns the mounting end 334 of the odd contacts 330 with the contact holes 108 in the PCB 102. The odd contact chicklet body 732 can replace the function of the organizer 350 and 550 in the embodiments described above by lining up the mounting ends 334 of the odd contacts 330 with the electric contact holes 108 in the PCB 102.

Similar to the even rib projection 744 of the even contact chicklet 740, the odd rib projection 734 of the odd contact chicklet 730 is inserted into the window 714 in the back plate 713 of the shield 710 during assembly. In one embodiment approximately half of the window 714 receives the odd rib projection 734 when the odd rib projection 734 is inserted into the window 714. For example, the odd and even rib projections 734 and 744 may be side-by-side in the window 714 with the inside edges of the odd and even rib projections 734 and 744 being held in contact by the window 714. The window 714 may hold the odd and even rib projections 734 and 744 of the contact chicklets 730 and 740 together, thus holding the contact chicklets 730 and 740 together.

The alignment pin 736 is inserted into a corresponding alignment hole 106 in the PCB 102 to align the receptacle 700 on the PCB 102. The odd contact chicklet 730 optionally includes a retaining tab similar to the retaining tab 741 of the even contact chicklet 740. The retaining tab of the odd contact chicklet 730 also is inserted into the retaining slot 724 of the housing 720 to secure the odd contact chicklet 730.

Additionally, the odd contact chicklet 730 optionally includes holes or other indentations on the side of the chicklet 730 that contacts the even contact chicklet 740 during assembly. The holes match up with the securing pins 748 on the even contact chicklet 740 and secure the odd and even contact chicklets 730 and 740 together when the odd and even contact chicklets 730 and 740 are pressed together.

Figure 8A:
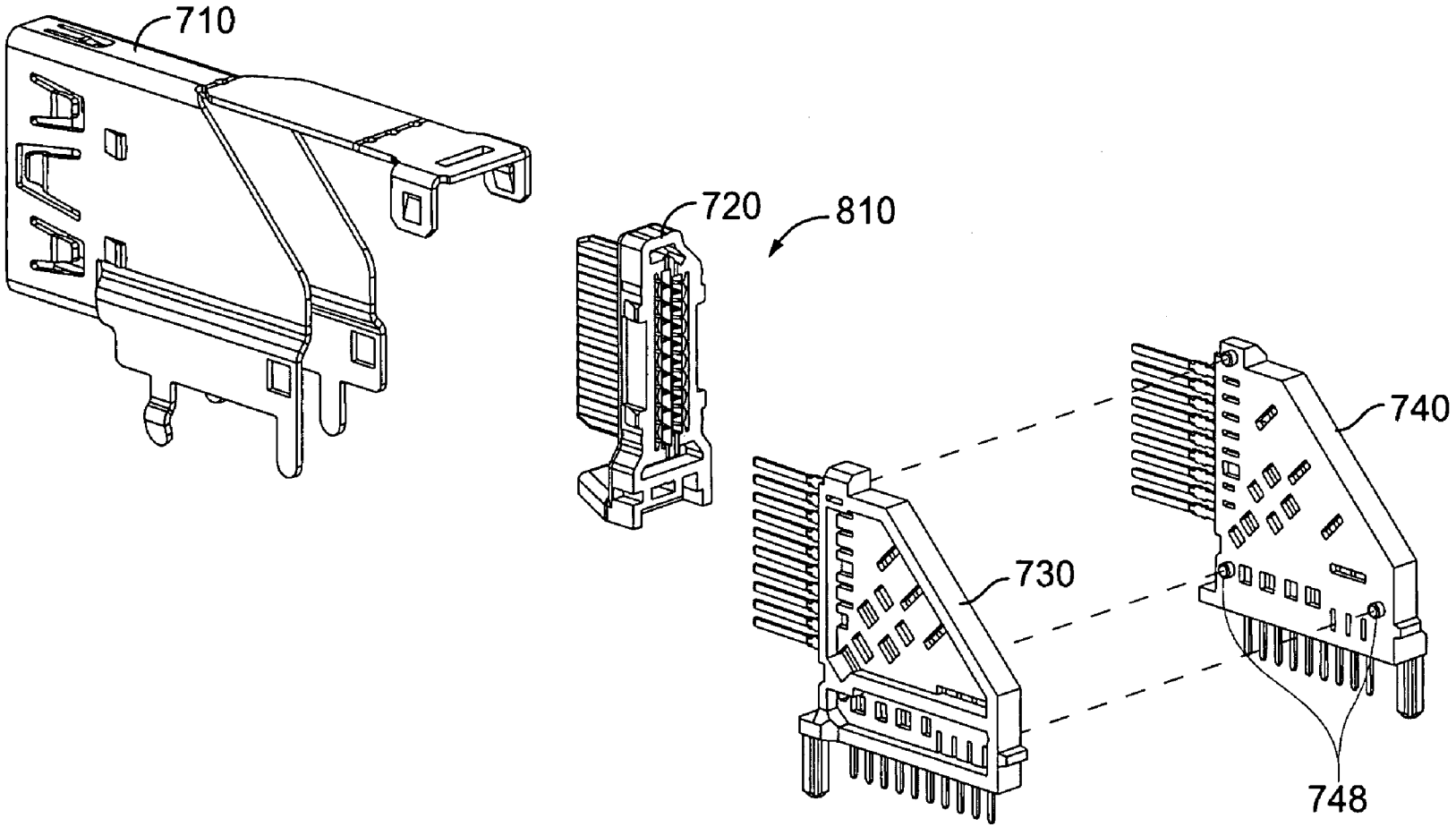
FIGS. 8A, 8B, 8C, 8D and 8E illustrate the receptacle shown in FIG. 7 at various stage of assembling, the receptacle.

FIGS. 8A, 8B, 8C, 8D and 8E illustrate the receptacle 700 shown in FIG. 7 at various stage of assembling the receptacle 700. First, as shown in FIG. 8A, at stage 810 the odd and even contact chicklets 730 and 740 are attached to one another. As described above, the chicklets 730 and 740 can be connected by inserting the securing pins 748 on the even contact chicklet 740 into matching holes or indentations on the odd contact chicklet 730.

Figure 8B:
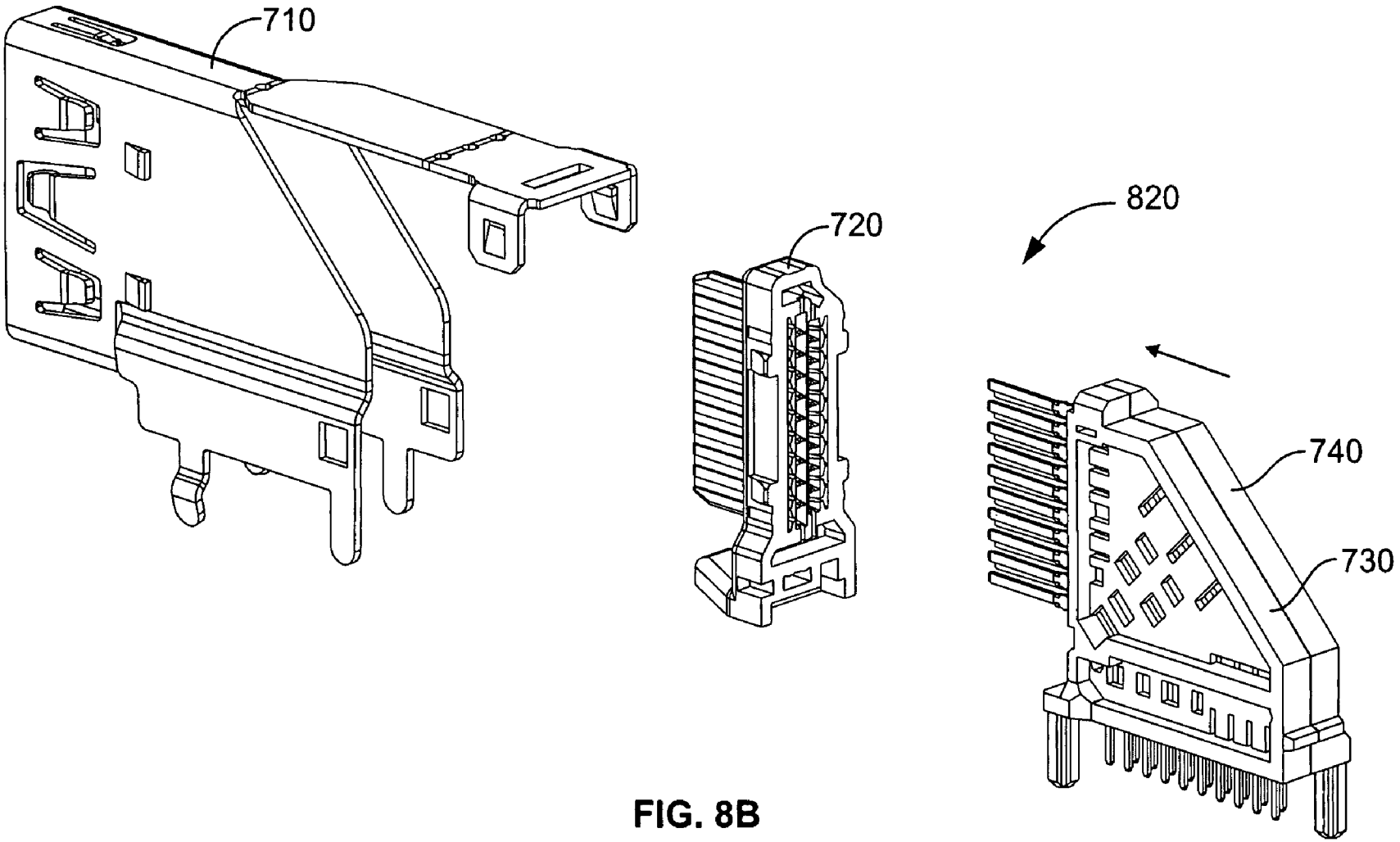

Next, as shown in FIG. 8B, at stage 820 the combination of the odd and even contact chicklets 730 and 740 is inserted into the housing 720. For example, the mating ends 332 and 334 (shown in FIG. 7) of the odd and even contacts 330 and 340 are inserted into the corresponding sets of holes 322 and 324 (shown in FIG. 7). The mating ends 332 and 334 are exposed on the opposite side of the housing 720 at the tongue 321 (shown in FIG. 7) of the housing 720.

At stage 820, the retaining tab 741 (shown in FIG. 7) on the even contact chicklet 740 (and a similar retaining tab on the odd contact chicklet 730 if one is included) is inserted into the retaining slot 724 (shown in FIG. 7) in the housing 720. As described above, this can secure the odd and even contact chicklets 730 and 740 to the housing 720.

Once the odd and even contact chicklets 730 and 740 are combined with the housing 720, the resulting combination is similar to the combination of the housing 520, the odd and even contacts 330 and 340, and the organizer 550 in the embodiment shown in FIGS. 5 and 6. The combination of the odd and even contact chicklets 730 and 740 with the housing 720 may protect the odd and even contacts 330 and 340 and line up the mating ends 332, 342 of the odd and even contacts 330, 340 for contact with the plug 240 (as shown in FIG. 2). This combination also lines up the mounting ends 334, 344 of the odd and even contacts 330, 340 for insertion into the contact holes 108 of the PCB 102 (as shown in FIG. 1).

Figure 8C:
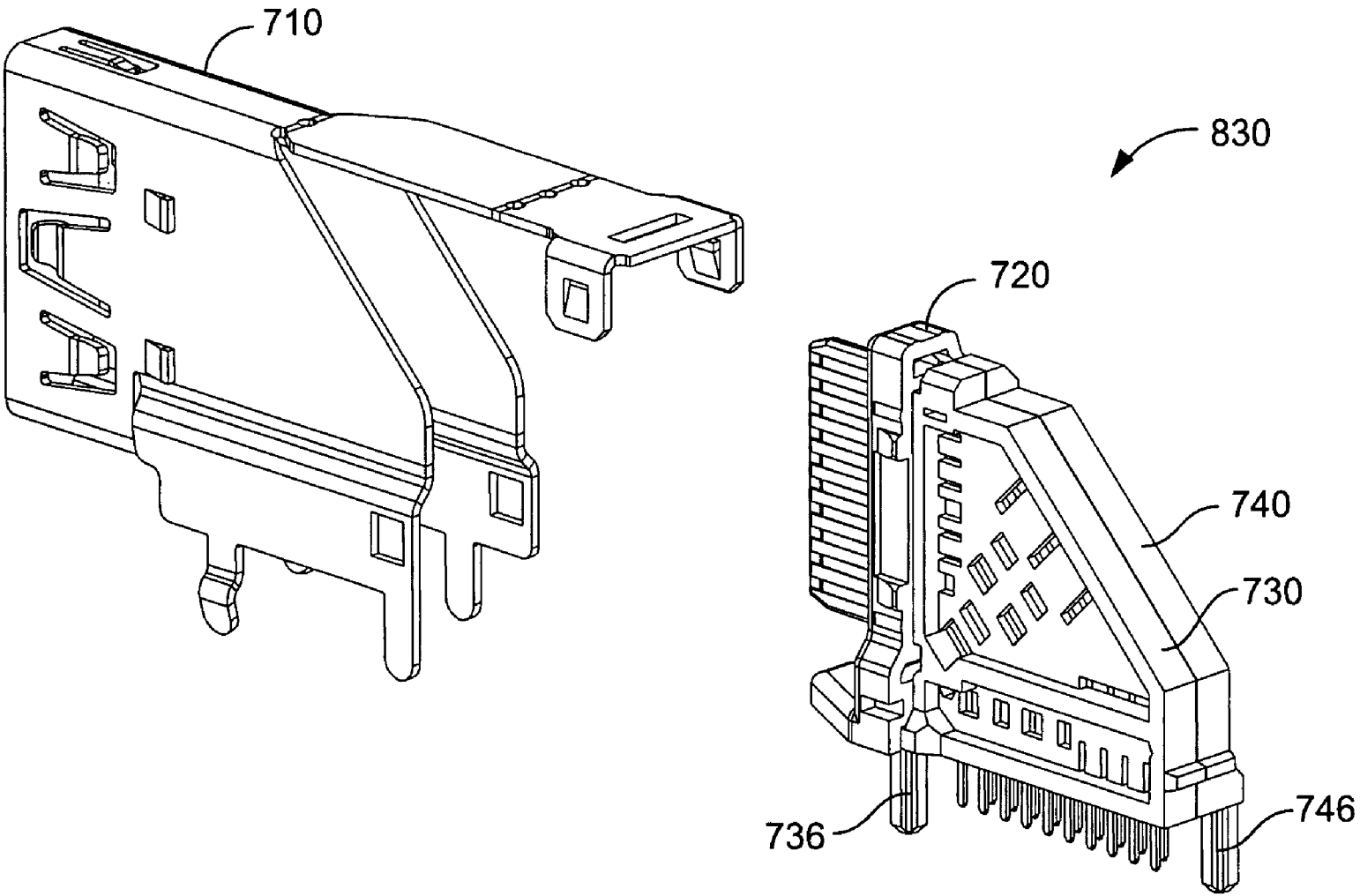

Next, as shown in FIG. 8C, at stage 830 the combination of the housing 720 and the odd and even contact chicklets 730 and 740 is inserted into the shield 710. This combination is inserted until the securing projections 328 (shown in FIG. 7) on the housing 720 match up with and are inserted into the inside surface of the securing projections 312 on the shield 710. At that point, a snap fit connection is established between the housing 720 and the shield 710.

Figure 8D:
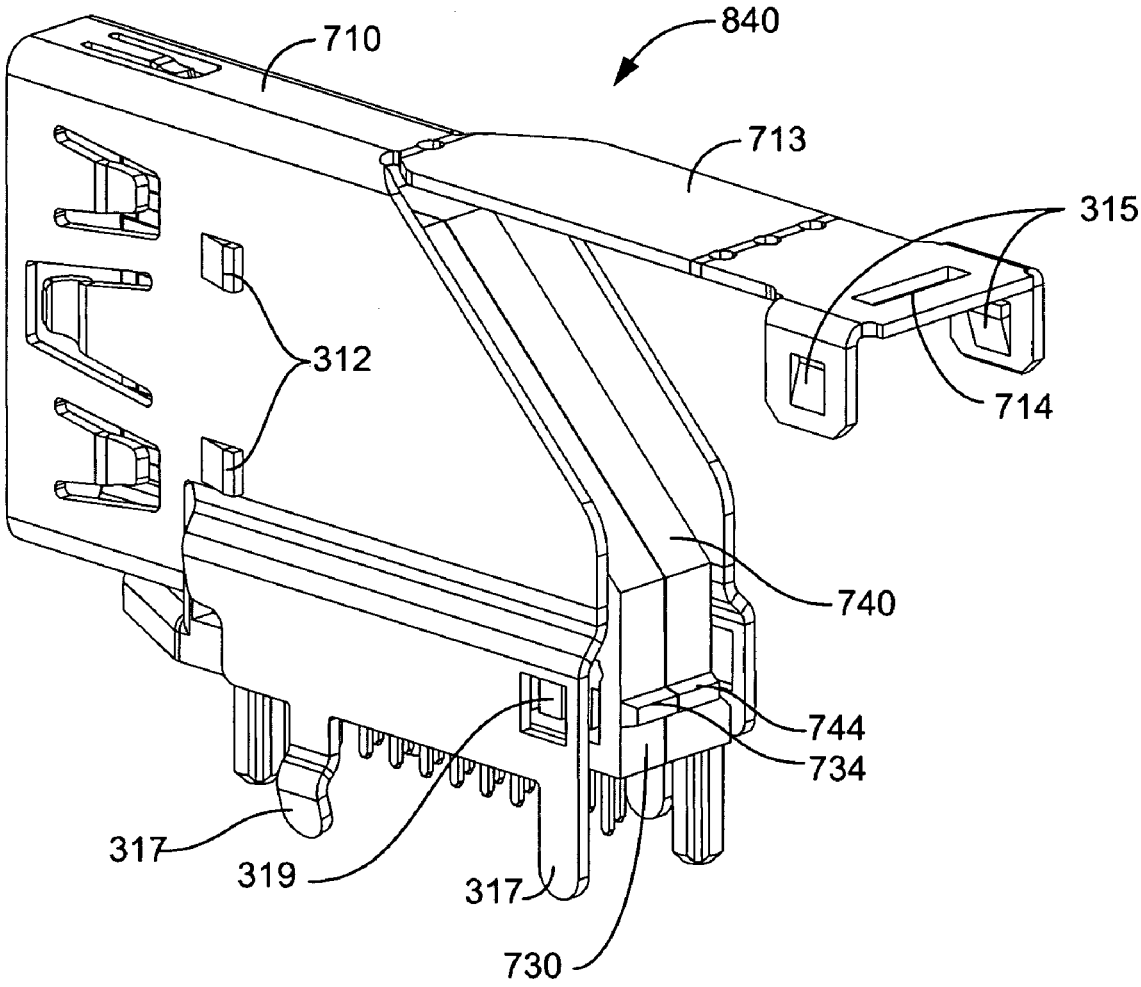

Next, as shown in FIG. 8D, at stage 840 the back panel 713 of the shield 710 is bent and lowered towards the shield pins 317. The back panel 713 is bent along the contours of the shield 710 until the closure indentations 315 on each side of the back panel 713 are inserted into the windows 319. Once the closure indentations 315 are inserted into the windows 319, a snap fit connection is established that prevents the back panel 713 from moving back towards its original position.

As the back panel 713 is bent towards the shield pins 317, the window 714 in the panel 713 is paced over the odd and even rib projections 734 and 744 on the odd and even contact chicklets 730 and 740. The insertion of the odd and even rib projections 734 and 744 into the window 714 secures the position of the odd and even contact chicklets 730 and 740 within the shield 710. Additionally, the odd and even rib projections 734 and 744 can prevent the back panel 713 from bending back towards its original position.

Figure 8E:
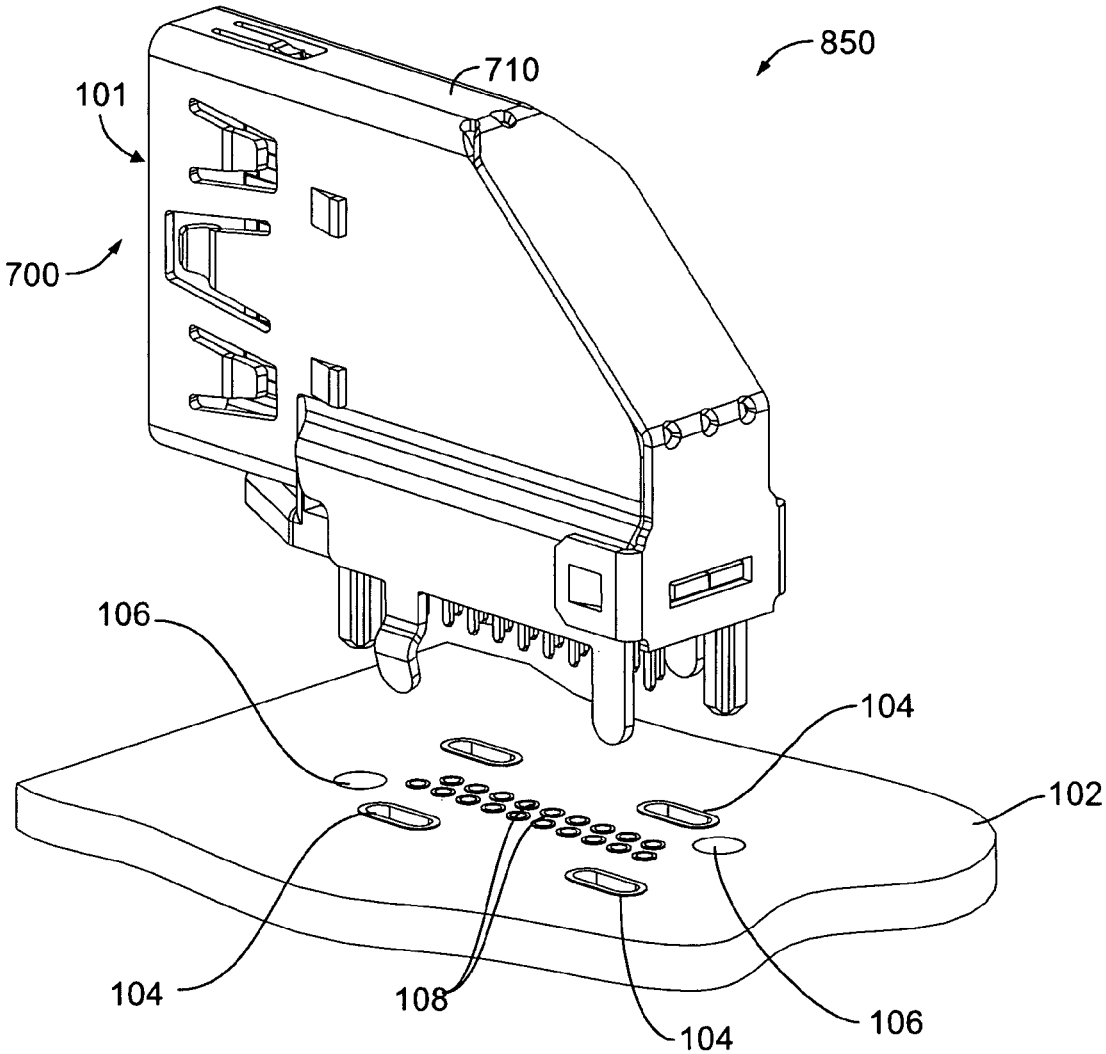

Next, as shown in FIG. 8E, at stage 850 the receptacle 700 is mounted onto the PCB 102. For example, the shield pins 317 (shown in FIG. 8D) can be inserted into the shield pin holes 104 in the PCB 102, the alignment pins 736 and 746 (shown in FIG. 8C) of the odd and even contact chicklets 730 and 740 (shown in FIG. 8C) can be inserted into the alignment pin holes 106 in the PCB 102, and the mounting ends 334 and 344 (shown in FIG. 7) of the odd and even contacts 330 and 340 (shown in FIG. 7) can be inserted into the electric contact holes 108 in the PCB 102. Optionally, the alignment pins 736 and 746 are longer than the extent of the mounting ends 334 and 344 of the odd and even contacts 330 and 340 that protrude from a mounting side 701 (shown in FIG. 7) of the receptacle 700. In such an embodiment, the alignment pins 736 and 746 enter the alignment pin holes 106 to align the mounting ends 334 and 344 of the contacts 330 and 340 with the holes 108 in the PCB 102 before the mounting ends 334 and 344 are inserted into the holes 108.

The receptacles 100, 300, 500 and 700 can be used as a receptacle to communicate data between two devices. For example, a cable connected to an external computing device can be plugged into the receptacle 100, 300, 500 and 700 and communicate data to and from another device connected to the receptacle 100, 300, 500 or 700. The receptacle 100, 300, 500 and 700 can be, for example, a Type A HDMI receptacle in accordance with HDMI Specification version 1.3.

The receptacles 100, 300, 500 and 700 include many improvements over horizontally mounted stacked receptacles 220. For example, the receptacle 100, 300, 500 or 700 can be mounted perpendicular to the PCB 102 (shown in FIG. 1).

The perpendicular mounting of the receptacles 100, 300, 500 and 700 on the PCB 102 allows for the footprints of the receptacles 100, 300, 500 and 700 to have a significantly smaller pitch 244 (shown in FIG. 2) than the pitch 242 (shown in FIG. 2) of the horizontally mounted stacked receptacles 220 (shown in FIG. 2). As a result, the receptacles 100, 300, 500 and 700 can use existing space on the PCB 102 much more efficiently than the horizontally mounted stacked receptacles 220. Additionally, the openings 101 (shown in FIG. 1) of the receptacles 100, 300, 500 or 700 can use existing real estate on the outside of a device much more efficiently that the openings 230 (shown in FIG. 2) of the horizontally mounted stacked receptacles 220 (shown in FIG. 2).

In another example, the vertical mounting of the receptacles 100, 300, 500 and 700 and the orientation of the shield 103, 310, 510 or 710 around the receptacles 100, 300, 500 and 700 can provide for improved electromagnetic shielding when compared to the horizontally mounted stacked receptacles 220. The shields, 103, 310, 510 and 710 of the receptacles 100, 300, 500 and 700 can cover a greater portion of the total surface area of the receptacles 100, 300, 500 and 700 than do the electromagnetic shields for horizontally mounted stacked receptacles 220. Consequently, the shields 310, 510 and 710 of the receptacles 100, 300, 500 and 700 can provide better shielding of the electric contacts 330 and 340 from electromagnetic interference.

In yet another example, the many securing projections (for example, 312, 316, 328, 356), retaining indentations (for example, 314, 318), closure indentations (for example, 315), securing pins (for example, 552, 748), odd and even rib projections (for example, 734, 744), and retaining tabs (for example, 741) can improve the stability-of the receptacles 100, 300, 500 and 700. As described above, these components in the various embodiments assist in securing and retaining various other components in their proper locations within the receptacles 100, 300, 500 and 700.

In another example, the alignment pins (for example, 352, 736 and 746) align the receptacles 100, 300, 500 and 700 with respect to the PCB 102. These pins can help ensure that the mounting ends 334 and 344 of the odd and even contacts 330 and 340 that mount to the PCB 102 are properly lined up with their corresponding holes 108, thus avoiding or reducing damage to the contacts 330 and 340.

Figure 9:
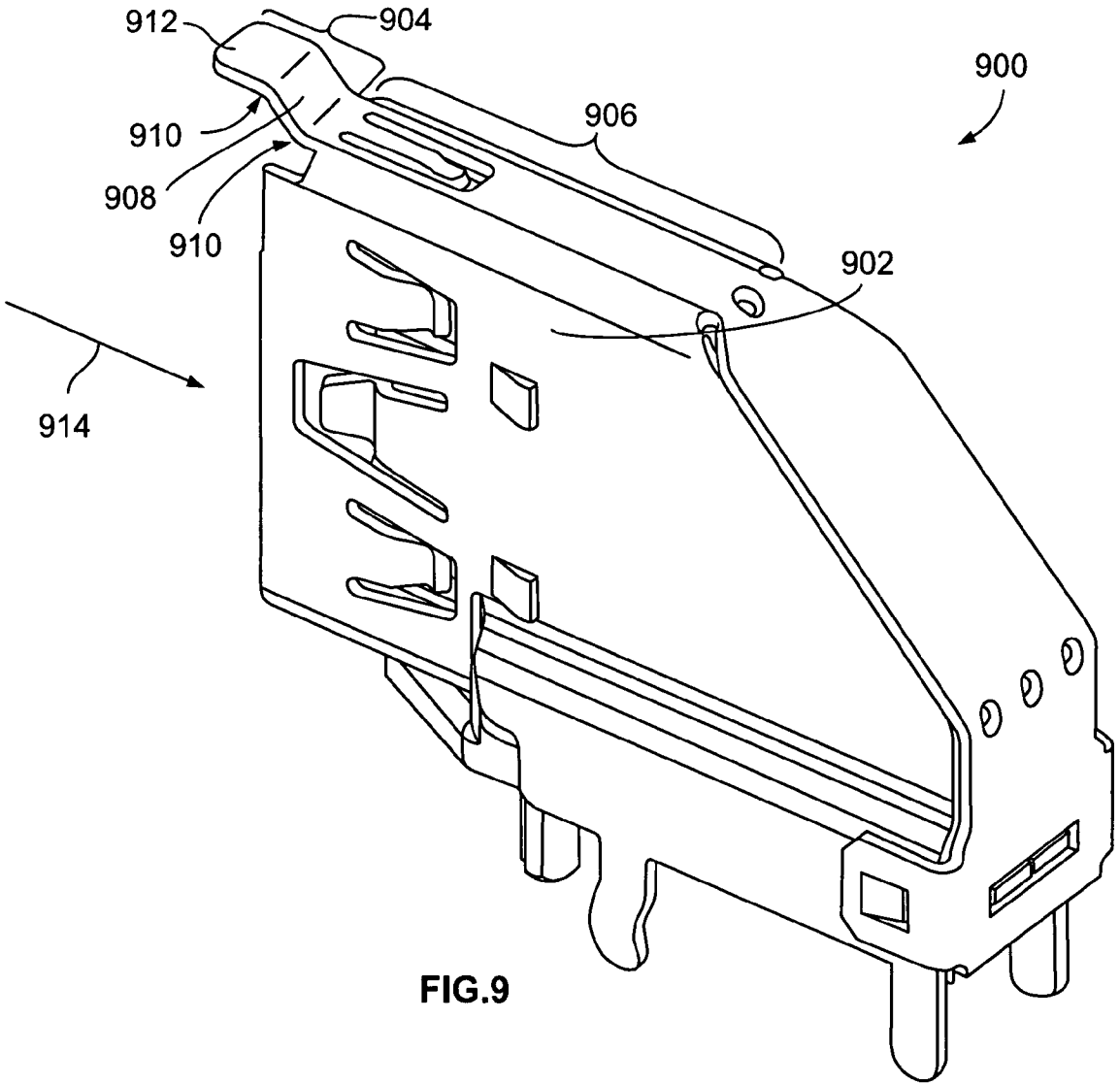
FIG. 9 is a rear perspective view of a vertically mounted receptacle according to another embodiment.

FIG. 9 is a rear perspective view of a vertically mounted receptacle 900 according to another embodiment. The vertically mounted receptacle 900 is similar to one or more of the vertically mounted receptacles shown in FIGS. 1 through 8 and described above. The vertically mounted receptacle 900 includes a shield 902 that is similar to the shields of one or more of the vertically mounted receptacle shown in FIGS. 1 through 8 and described above. A retention tab 904 protrudes from an upper portion 906 of the shield 902. As shown in FIG. 9, the retention tab 904 protrudes from the vertically mounted receptacle 900 in a direction that opposes a loading direction 914. The loading direction 914 is the direction in which the electrical connector plug 240 is loaded into the vertically mounted receptacle 900. For example, the retention tab 904 forwardly protrudes from the shield 902 in the illustrated embodiment.

Figure 10:
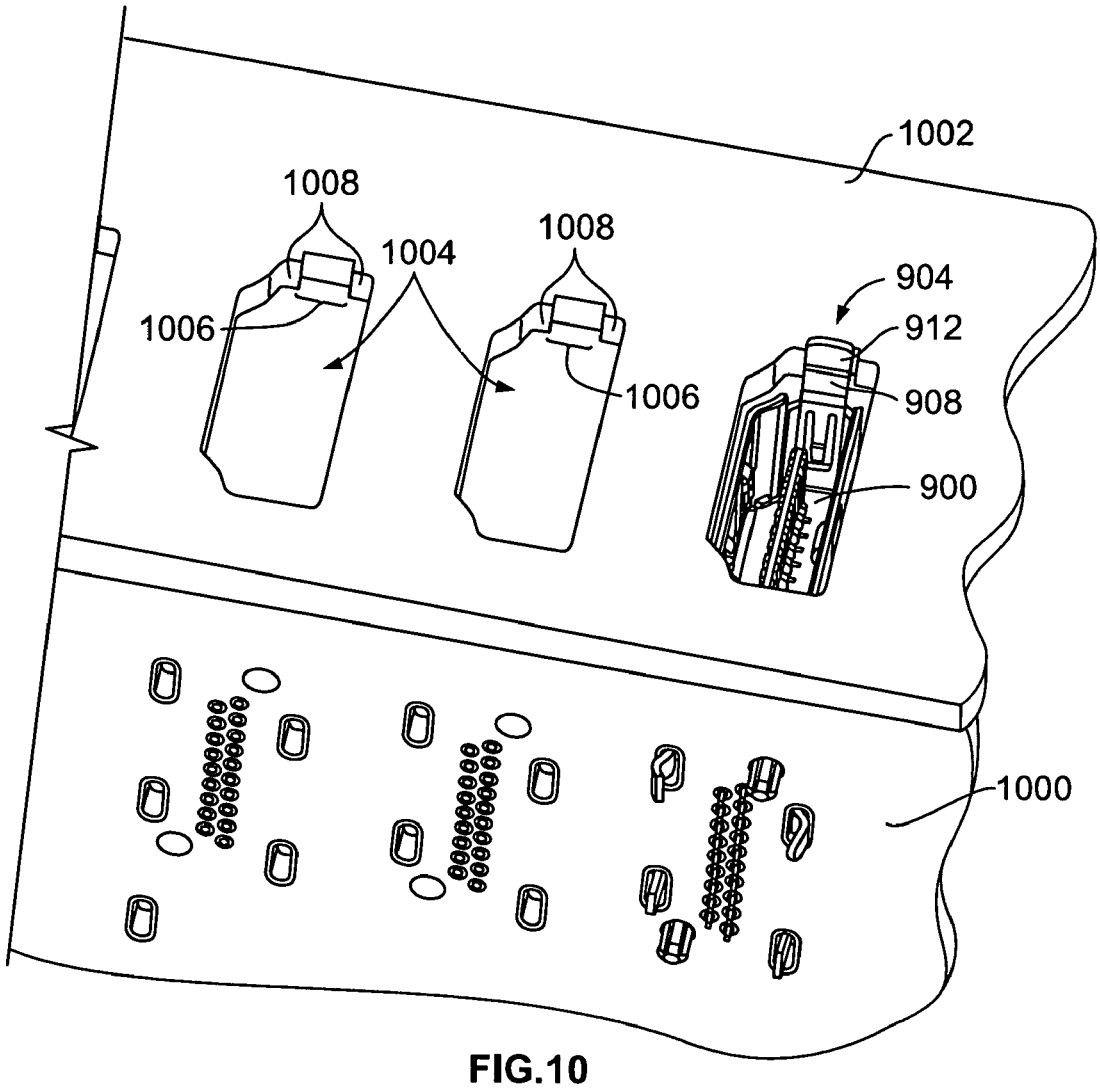
FIG. 10 is a perspective view of the vertically mounted receptacle shown in FIG. 9 mounted on a circuit board according to one embodiment.

The retention tab 904 secures the vertically mounted receptacle 900 in a receptacle opening 1004 (shown in FIG. 10) in a panel surface 1002 (shown in FIG. 10). In the illustrated embodiment, the retention tab 904 includes an angled portion 908 disposed between a plurality of bends 910. The angled portion 908 includes an extension of the shield 902 that is disposed at an angle relative to the upper portion 906 of the shield 902. A flat portion 912 extends from the angled portion 908. In the illustrated embodiment, the flat portion 912 is substantially horizontal to the upper portion 906. The retention tab 904 is separated from the upper portion 906 by one of the bends 910 and the angled and flat portions 908, 912 are separated from one another by another one of the bends 910. As shown in FIG. 9, the angled portion 908 causes the flat portion 912 to be disposed above the upper portion 906. In one embodiment, the shield 902 and retention tab 904 are integrally formed with one another. For example, the shield 902 and the retention tab 904 may be homogeneously formed with one another, such as by stamping and forming the shield 902 and the retention tab 904 from a common sheet of conductive material. One example of the sheet of conductive material includes a metal material.

FIG. 10 is a perspective view of the vertically mounted receptacle 900 mounted on a circuit board 1000 according to one embodiment. The circuit board 1000 may be similar to the circuit board 102 shown in FIG. 1. The panel surface 1002 similar to the panel surface 232 (shown in FIG. 2) is disposed proximate to the circuit board 1000. The panel surface 1002 includes a plurality of the receptacle openings 1004. Each of the receptacle openings 1004 is shaped to receive the plug end 241 (shown in FIG. 2) of the electrical connector plugs 240 (shown in FIG. 2) so the plug end 241 can be loaded into the vertically mounted receptacle 900. In the illustrated embodiment, the receptacle openings 1004 include a slot 1006 disposed along an upper edge 1008 of the receptacle openings 1004. The slots 1006 are shaped to receive the retention tab 904 of the vertically mounted receptacle 900. As shown in FIG. 9, the retention tab 904 protrudes through the receptacle opening 1004 in a location that is proximate to the upper edge 1008 of the receptacle opening 1004. In one embodiment, the retention tab 904 protrudes through the receptacle opening 1004 sufficiently far such that the flat portion 912 of the retention tab 904 extends past the panel surface 1002 and the angled portion 908 of the retention tab 904 engages the upper edge 1008 of the receptacle opening 1004 in the slot 1006. In another embodiment, the flat portion 912 engages the upper edge 1008 in the slot 1006.

The slot 1008 receives the retention tab 904 and the retention tab 904 engages the upper edge 1008 to prevent displacement of the vertically mounted receptacle 900 away from the panel surface 1002 in a direction opposite of the loading direction 914 (shown in FIG. 9). For example, the vertically mounted receptacle 900 is prevented from moving away from the panel surface 1002 as the plug end 241 (shown in FIG. 2) of the electrical connector plug 240 (shown in FIG. 2) is loaded into the vertically mounted receptacle 900 through the receptacle opening 1004.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters, of certain embodiments and are by no means limiting and merely are example embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle assembly for an electrical connector comprising:

a conductive shield having a mating interface elongated along a longitudinal axis and configured to receive the electrical connector, the shield configured to be mounted to a circuit board;

a housing disposed within the shield, the housing having a mating end and a mounting end oriented orthogonal to one another, the mating end elongated along the longitudinal axis and including a tongue oriented parallel to the longitudinal axis, the housing comprising holes through the housing on opposite sides of the tongue; and contact chicklets engaged with the housing and disposed within the shield, the contact chicklets including electrical contacts that extend between mating ends and mounting ends oriented orthogonal to one another, the contact chicklets engaging the housing such that the mating ends of the contacts extend through the holes in the housing and are presented on the opposite sides of the tongue, wherein the tongue of the housing is oriented perpendicular to the circuit board, wherein each of the contact chicklets includes a rib projection and the shield includes a window that receives the rib projections to secure the contact chicklets together.

2. The receptacle assembly in accordance with claim 1, wherein the shield comprises a back plate oriented at an oblique angle with respect to the longitudinal axis and windows disposed in opposite sides of the shield, the back plate having closure indentations inserted into the windows.

3. The receptacle assembly in accordance with claim 1, wherein the holes in the housing are arranged in parallel rows oriented in directions parallel to the longitudinal axis.

4. The receptacle assembly in accordance with claim 1, wherein the housing includes a retaining slot extending into the housing and the contact chicklets include retaining tabs received into the retaining slot in a side-by-side abutted relationship.

5. The receptacle assembly in accordance with claim 1, wherein the shield includes protrusions outwardly extending from the shield and the housing includes protrusions outwardly extending from the housing, the protrusions of the housing received within the protrusions of the shield on the inside of the shield.

6. The receptacle assembly in accordance with claim 1, further comprising an organizer disposed within the shield and mountable to at least one of the housing and the shield, the organizer including holes through which the mounting ends of the electrical contacts extend.

7. The receptacle assembly in accordance with claim 1, wherein the shield receives the electrical connector through an opening in a panel, the shield comprising a retention tab protruding forward and upward from the shield, the retention tab extending forward from the shield through the opening in the panel and upward from the shield on an opposite side of the panel to engage the panel.

8. The receptacle assembly in accordance with claim 7, wherein the retention tab comprises an angled portion and a flat portion, the angled portion angled with respect to the longitudinal axis and extending through the opening in the panel, the flat portion coupled to the angled portion and disposed on the opposite side of the panel with respect to the shield when the retention tab extends through the opening in the panel.

9. The receptacle assembly of claim 1, wherein the holes are arranged in parallel rows extending along the opposite sides of the tongue, the contacts disposed in one of the contact chicklets extending through the holes on one of the opposite sides of the tongue and the contacts disposed in another one of the contact chicklets extending through the holes on the other of the opposite sides of the tongue.

10. The receptacle assembly of claim 9, wherein the mating ends and the mounting ends of the contacts are oriented perpendicular to one another.

11. The receptacle assembly of claim 9, wherein the opposite sides of the shield include windows and the back side of the shield includes indentations, further wherein the back side secured to the opposite sides when the indentations are received in the windows.

12. An electrical contact device comprising:

first and second contact chicklets each housing a set of electrical contacts, wherein mating ends of the electrical contacts are configured to communicate with an electrical connector, mounting ends of the electrical contacts are configured to be mounted to a circuit board, and the mating and mounting ends of the electrical contacts are perpendicular to each other; and a shield having a window, wherein each of the first and second contact chicklets includes a rib projection, the window configured to receive the rib projections to secure the contact chicklets together such that an inside edge of the rib projections are held in contact with one another by the window.

13. The electrical contact device in accordance with claim 12 wherein each of the first and second contact chicklets includes an alignment pin configured to insert into the circuit board and align the device on the circuit board.

14. The electrical contact device in accordance with claim 13 wherein the mounting ends of the electrical contacts protrude from a mounting end of each of the contact chicklets and the alignment pin protrudes from the mounting ends of the contact chicklets, wherein the alignment pin of each of the contact chicklets extends farther from the mating ends of the contact chicklets than the electrical contacts.

15. The electrical contact device in accordance with claim 12 wherein the first contact chicklet includes a pin and the second contact chicklet includes an opening that receives the pin, the pin being held within the opening by a friction fit.

16. The electrical contact device in accordance with claim 12 further including a housing having a mating end elongated along a longitudinal axis of the housing, wherein the mating ends of the electrical contacts pass through the mating end of the housing.

17. The electrical contact device in accordance with claim 16 wherein the housing includes a retaining slot and at least one of the contact chicklets includes a retaining tab that fits into the retaining slot to secure the housing with respect to the contact chicklets.

* * * * *